US007171132B2

(12) United States Patent
Yabuki et al.

(10) Patent No.: US 7,171,132 B2
(45) Date of Patent: Jan. 30, 2007

(54) IMAGE FORMING APPARATUS HAVING POSITION CONTROLLER

(75) Inventors: Makoto Yabuki, Tokyo (JP); Hiroyuki Inoue, Tokyo (JP); Yasunaga Yamaguchi, Tokyo (JP); Kazuaki Arai, Tokyo (JP)

(73) Assignee: Oki Data Corporation, Tokyo (JP)

( * ) Notice: Subject to any disclaimer, the term of this patent is extended or adjusted under 35 U.S.C. 154(b) by 218 days.

(21) Appl. No.: 10/876,074

(22) Filed: Jun. 24, 2004

(65) Prior Publication Data

US 2004/0264984 A1 Dec. 30, 2004

(30) Foreign Application Priority Data

Jun. 27, 2003 (JP) ..... 2003-184406

(51) Int. Cl.
*G03G 15/08* (2006.01)

(52) U.S. Cl. ..... 399/27; 399/13; 399/61; 399/120

(58) Field of Classification Search ..... 399/27, 399/13, 61, 120; 222/DIG. 1
See application file for complete search history.

(56) References Cited

U.S. PATENT DOCUMENTS 4,668,074 A * 5/1987 Hirozane ..... 399/27
5,864,731 A * 1/1999 Ikemoto et al. ..... 399/27
6,496,662 B1 * 12/2002 Buchanan et al. ..... 399/27
6,546,213 B2 4/2003 Ito et al.
2003/0031479 A1 * 2/2003 Ito ..... 399/27
2003/0228160 A1 * 12/2003 Inoue et al. ..... 399/27

FOREIGN PATENT DOCUMENTS

JP 02-020887 A * 1/1990
JP 05-165332 A * 7/1993
JP 10-186774 A 7/1998
JP 2002-072657 A 3/2002
JP 2003-050505 A 2/2003

* cited by examiner

*Primary Examiner*—Sophia S. Chen
(74) *Attorney, Agent, or Firm*—Akin Gump Strauss Hauer & Feld, LLP

(57) ABSTRACT

An image-forming apparatus includes an image-forming section, a detection section, and a controller. The image-forming section has an image-bearing body on which an electrostatic latent image is formed and a developing unit that develops the electrostatic latent image. The detection section generates an output indicative of a remaining amount of toner in the developing unit. The controller drives the drive section to cause the image-forming section to move from one position to another, and determines a position of the image-forming section based on the output of the detection section. The detection section is mounted to a toner cartridge within the developing unit. When the image-forming section is moved from one position to another, the detection section receives light reflected by a high-reflectivity area and a low-reflectivity area, thereby detecting the position of the image-forming section.

18 Claims, 32 Drawing Sheets

WHEN A LARGE AMOUNT OF TONER REMAINS

IMAGE FORMING APPARATUS HAVING POSITION CONTROLLER

BACKGROUND OF THE INVENTION

1. Field of the Invention

The present invention relates to an electrophotographic image-forming apparatus and a toner cartridge detachably attached to the electrophotographic image-forming apparatus.

2. Description of the Related Art

Japanese Patent Laid-Open No. 2002-72657 discloses a conventional image-forming apparatus that includes a toner cartridge with a toner-agitating rod. The toner-agitating rod has one end with a magnetic member and the other end coupled to a toner-agitating shaft. The apparatus has a top cover, which is pivotally coupled to a main body and has a sensor mechanism. The sensor mechanism has a permanent magnet that opposes the magnetic member. The sensor mechanism detects the rotation of the toner-agitating shaft. The toner-agitating rod performs sliding motion within a guide provided on the top cover and the sensor mechanism operates in cooperation with the sliding motion of the rod. The magnetic member at one end of the toner-agitating rod stays longer at the upper portion of the guide when a relatively small amount of toner remains in the toner cartridge, and shorter when a relatively large amount of toner remains in the toner cartridge. The sensor mechanism detects the difference in time and a controller checks the detection result to determine an amount of toner remaining in the toner cartridge.

With an electrophotographic image-forming apparatus, if a photoconductive drum remains in contact with a transport belt for a long period of time, chemical reaction takes place between these structural members, contaminating the surface of the photoconductive drum. In color printing, the image forming sections for four colors descend to their down-positions at which the photoconductive drums are in contact with the transport belt. In black only printing, the three color image-forming sections ascend to their up-positions at which the photoconductive drums are not in contact with the transport belt.

A sensor detects the movement of the image-forming section between its up-position and down-position to generate a binary detection signal.

With the aforementioned image-forming apparatus, because the sensor mechanism is located on the top cover which is pivotally coupled to the main body of the apparatus, the sensor mechanism cannot be accurately positioned relative to the toner cartridge. Thus, the toner remaining in the cartridge cannot be detected accurately.

The toner-agitating rod in the toner cartridge moves in the pile of toner and therefore, receives a large load. Additionally, because the toner-agitating rod also moves in the pile of toner, the toner tends to clog the guide. Clogging of the guide is an obstacle to the motion of the toner-agitating rod, causing errors in detecting a remaining amount of toner.

With the aforementioned color photographic printer, the image-forming sections are positioned at different heights relative to the transport belt for color printing and monochrome printing, thereby preventing contamination of the photoconductive drums. For this purpose, the motors for driving the image-forming sections are rotated in the reverse direction, and cam mechanisms and up-position and down-position sensors cooperate to change the heights of the image forming sections relative to the transport belt. However, each color image-forming section requires a corresponding sensor in order to switch the color image-forming section between the up-position and the down-position. In addition, the requirement of the circuits and control to detect the outputs of the sensors adds to the manufacturing costs.

SUMMARY OF THE INVENTION

An object of the invention is to provide an image-forming apparatus and a toner cartridge that is detachably attached to the image-forming apparatus.

Another object of the invention is to provide an image-forming apparatus in which image-forming sections are accurately positioned at their operative positions.

Still another object of the invention is to provide a toner cartridge having a toner detecting means for detecting a remaining amount of toner.

An image-forming apparatus includes an image-forming section, a detection section, a drive section, and a controller. The image-forming section has an image-bearing body on which an electrostatic latent image is formed thereon and a developing unit that applies toner to the electrostatic latent image. The detection section generates an output indicative of a remaining amount of toner in the developing unit. The drive section causes the image-forming section to move from one position to another. The controller drives the drive section to cause the image-forming section to move from one position to another and determines a position of the image-forming section based on the output of the detection section.

The detection section is mounted to a toner cartridge within the developing unit.

The image-forming section has an outer wall on which a high-reflectivity section and a low-reflectivity section are provided. When the image-forming section is moved from one position to another, the high-reflectivity section and the low-reflectivity section pass through a path of light emitted from the detection section in order, so that the detection section detects light reflected from the high-reflectivity section and the low-reflectivity section.

The image forming section has an outer wall having a bar code thereon. When the image-forming section is moved from one position to another, the bar code passes the detection section, so that the detection section reads the bar code.

The image-forming section is one of a plurality of image-forming sections that have different bar codes.

The position of the image-forming section is detected in terms of a duty cycle of an output waveform of the detection section.

The position of the image-forming section is detected in terms of a number of pulses of an output waveform of the detection section.

The developing unit includes a toner agitating member that agitates the toner therein. The high-reflectivity section is a reflection member that cooperates with the toner agitating member to perform rocking motion to indicate the remaining amount of toner. The low-reflectivity section is the outer wall surface of the image-forming section.

The low-reflectivity section is a dented area of the outer wall surface. The detection section has a focal distance longer than a distance between the detection section and the dented area when the dented area is in the path of light emitted from the detection section.

The low-reflectivity section is an outer wall surface on which diffusion reflection of incident light takes place.

A toner cartridge is detachably mounted on an image forming section that forms a toner image and includes a toner chamber, a toner-agitating member, and a detection section. The toner chamber holds toner therein. The toner-agitating member that agitates the toner in the toner chamber. The detection section located outside of the toner chamber and cooperating with the toner agitating member to detect a motion of the toner-agitating member.

The toner-agitating member includes a first portion that agitates the toner and a second portion that transmits a motion of the agitating member to the detection section. The detection section has one end with a driven portion and another end with a light reflecting portion, the detection section being supported at a fulcrum between the driven portion and the light reflecting portion so that the detection section is adapted to rock about the fulcrum.

The driven portion is a magnet and the second portion is formed of a magnetic material. When the second portion moves toward the driven portion, the second portion attracts the driven portion, and when the second portion moves away from the driven portion, the second portion does not attract the driven portion so that the detection section rocks about the fulcrum.

When the detection section rocks about the fulcrum, the light reflecting portion reflects light incident thereon, the light being reflected alternately in a first direction and in a second direction.

The toner cartridge further includes a toner-discharging opening through which the toner is discharged from the toner chamber, and a shutter member that opens and closes the toner-discharging opening. The detection section is mounted to the shutter member.

The toner cartridge still further includes an operation handle operated for opening and closing the shutter member. When the operation handle is operated, the detection section moves together with the shutter member.

The detection section has a light-reflecting member and the operation handle has a window through which light emitted from an external light source is incident on the light-reflecting-member.

When the operation handle is operated, the light-reflecting member takes a reflecting position where the light-reflecting member reflects the light emitted from the external light source and a non-reflecting position where the light-reflecting member does not reflect the light emitted from the external light source.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DESCRIPTION OF THE INVENTION

Preferred embodiments of an electrophotographic image forming apparatus according to the invention will be described.

First Embodiment

{Construction}

Figure 1:
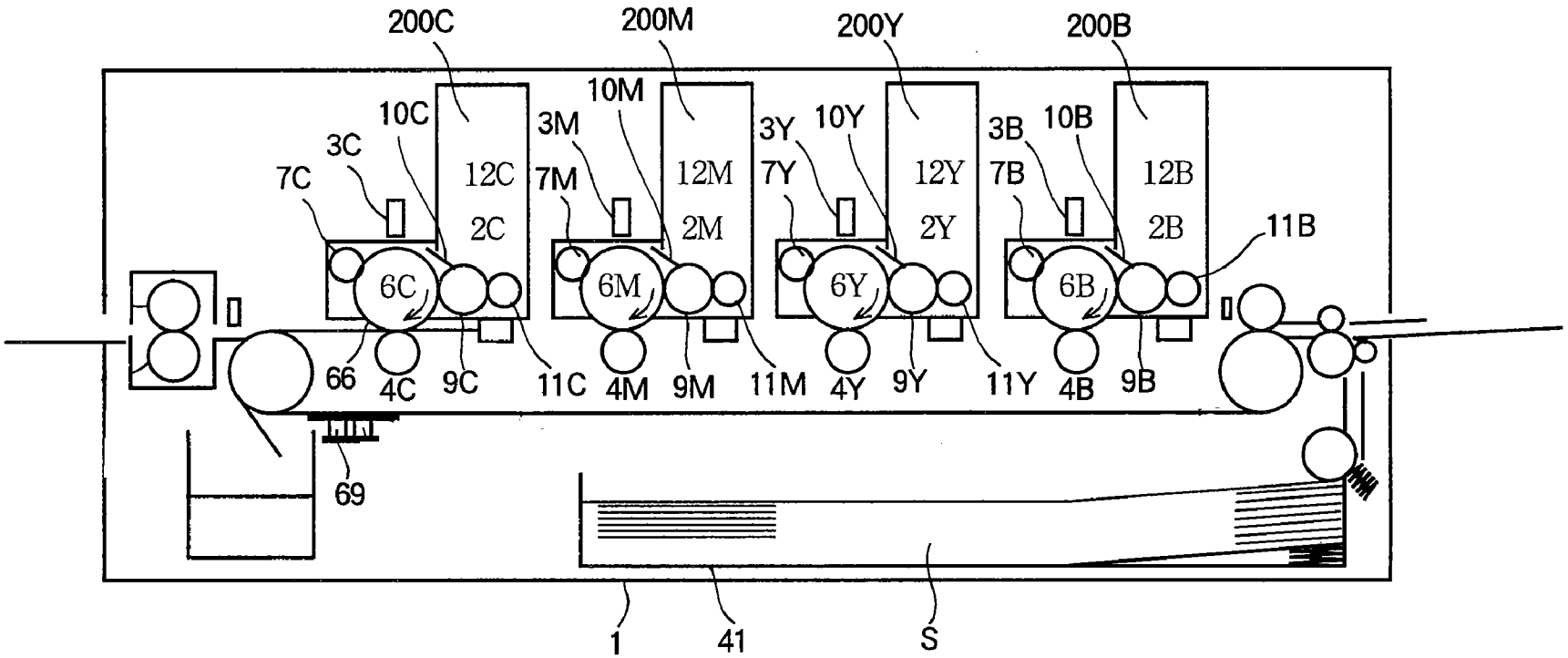
FIG. 1 illustrates a color image-forming apparatus according to the invention.

FIG. 1 illustrates a color image-forming apparatus according to the invention. A paper cassette 41 holds a stack of print paper S. A color image-forming apparatus 1 includes four image-forming sections 2B, 2Y, 2M, and 2C, which are LED electrophotographic print engines aligned in a direction from a medium feeding port to a medium exiting port to form black, yellow, magenta, and cyan images.

The print engines include photoconductive drums 6B, 6Y, 6M, and 6C, charging rollers 7B, 7Y, 7M, and 7C, LED heads 3B, 3Y, 3M, and 3C, developing units 12B, 12Y, 12M, and 12C, and transfer rollers 4B, 4Y, 4M, and 4C.

The charging roller rotates in contact with the photoconductive drum to charge the surface of the photoconductive drum uniformly. The LED head illuminates the charged surface of the photoconductive drum in accordance with print data to form an electrostatic latent image.

The developing units 12B, 12Y, 12M, and 12C include developing blades 10B, 10Y, 10M, and 10C, sponge rollers 11B, 11Y, 11M, and 11C, developing rollers 9B, 9Y, 9M, and 9C, and toner cartridges 200B, 200Y, 200M, and 200C. The developing unit develops the electrostatic latent image with toner into a toner image. The transfer roller transfers the toner image from the photoconductive drum onto a recording medium. The image-forming sections 2B, 2Y, 2M, and 2C are driven in rotation by corresponding motors, not shown. The motors rotate in the forward direction during printing. When the image-forming section is moved to an up-position, the cyan motor is rotated in the reverse direction so as to a slide link 60 in a direction (arrow P in FIG. 14) in which the image-forming section moves to the up-position. In FIG. 1, the slide link 60 is omitted for simplicity's sake.

{Toner Cartridge}

A toner cartridge according to the present invention will be described.

Figure 2:
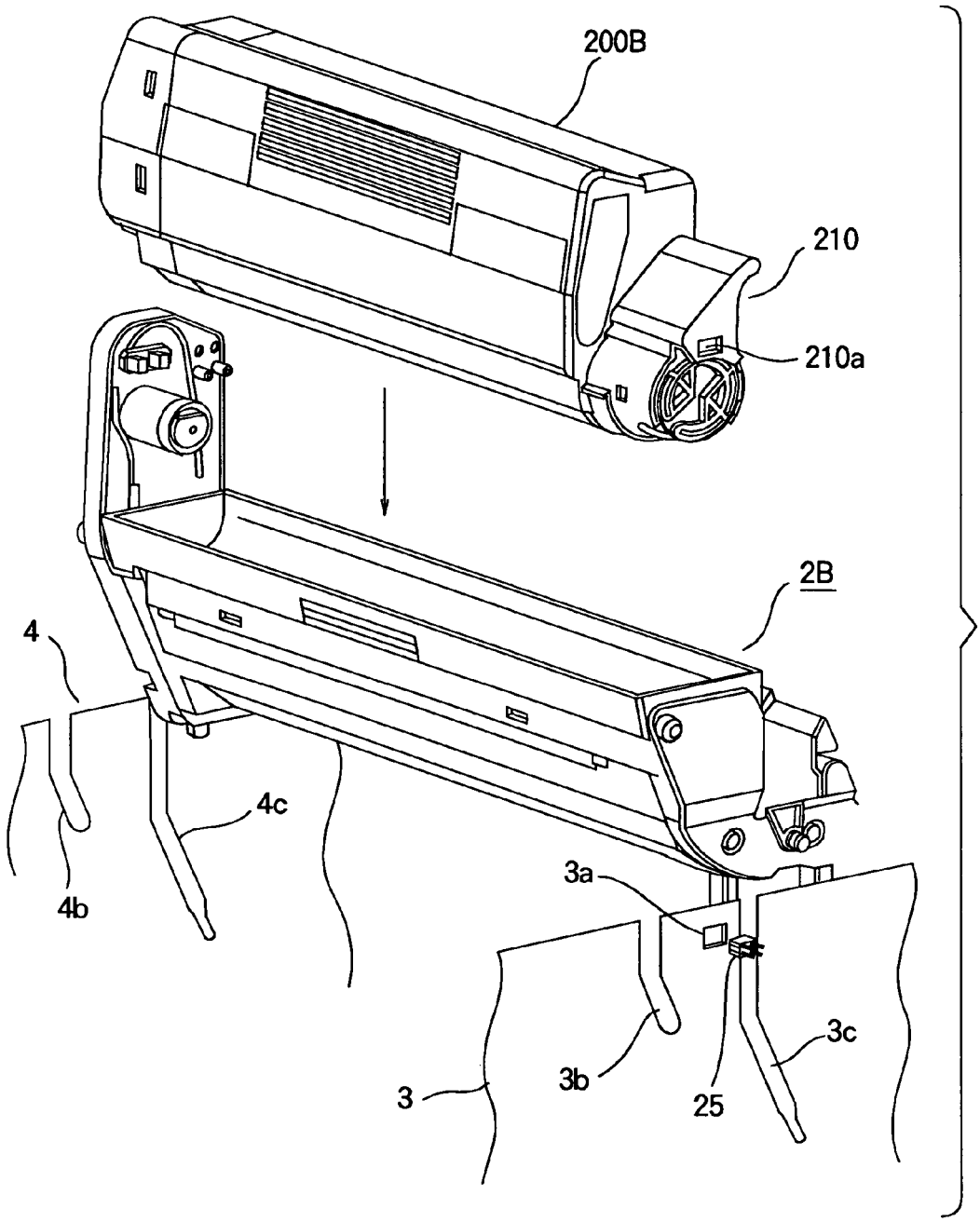
FIG. 2 illustrates an example of the structure of a toner cartridge for black toner.

FIG. 2 illustrates the structure of a toner cartridge 200B for black toner by way of example. The toner cartridge 200B includes a shutter lever 210 that is operated to pivot to discharge the toner held in the toner cartridge 200B. The shutter lever 210 has a window 210*a* formed therein.

Figure 4B:
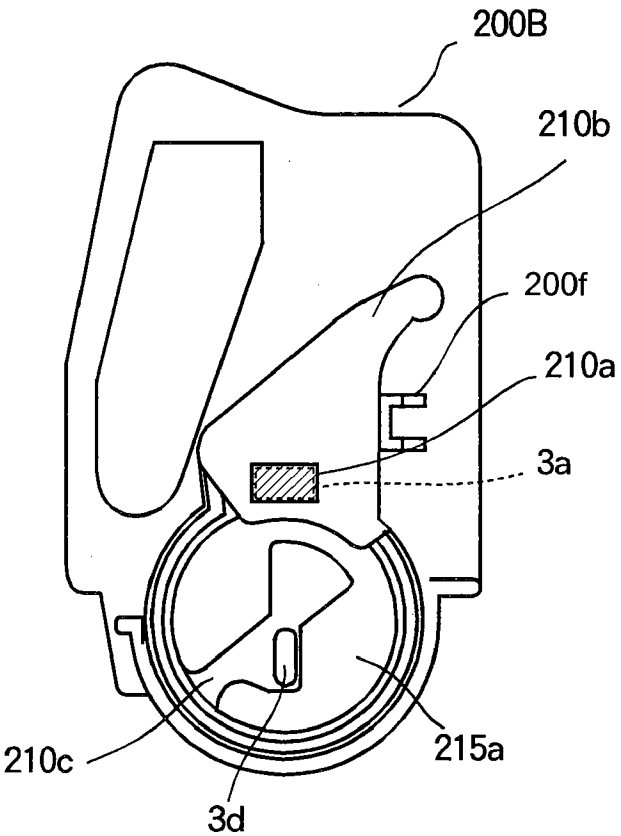
FIGS. 4A and 4B illustrate the positional relation between the rotational position of a shutter lever and a window in the frame of a main body.

The toner cartridge 200B is attached to the image-forming section 2B. The image-forming section 2B is guided in guide grooves 3*b* and 3*c* formed in a frame 3 of a main body of the image forming apparatus and guide grooves 4*c* and 4*b* formed in a frame 4. Thus, the image-forming section 2B is set in position in the apparatus. The frame 3 has a toner sensor 25 in the form of a reflection type photo-sensor. When the toner cartridge 200B is properly attached to the image-forming section 2B, the window 210*a* of the toner cartridge 200B opposes the toner sensor 25 (FIG. 4B).

Figure 3:
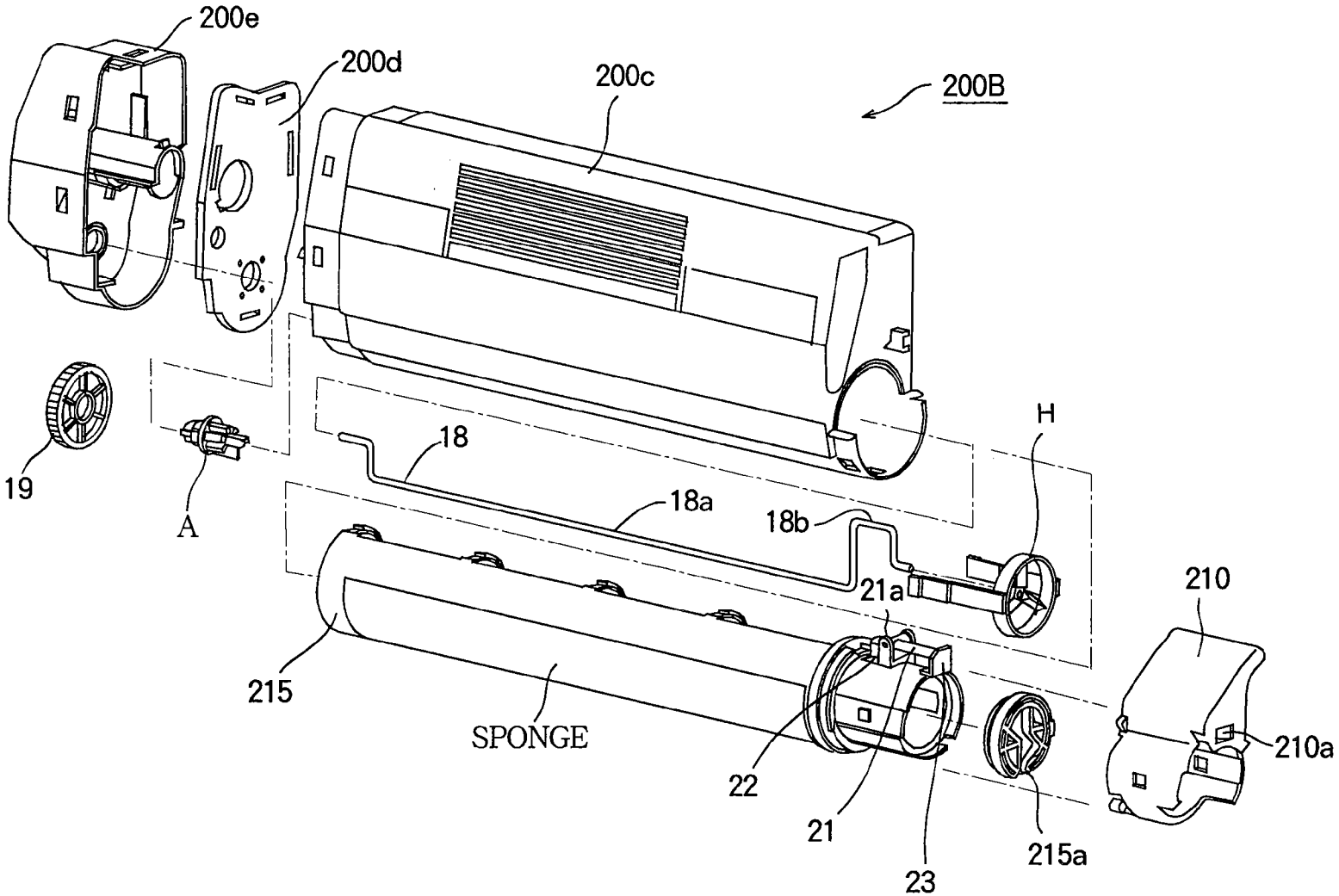
FIG. 3 is an exploded perspective view illustrating the configuration of the toner cartridge.

FIG. 3 is an exploded perspective view illustrating the configuration of the toner cartridge 200B.

A sponge plate 200*d* is attached to one longitudinal end of an outer case 200*c* and a plate 200*e* is attached to the outer case 200*c*, thereby fitting over the sponge plate 200*d*. The plate 200*e* has a gear 19 rotatably attached thereto. The rotation of the gear 19 is transmitted to a boss A. A shutter 215 is rotatably inserted into the outer case 200*c* from another longitudinal end of the outer case 200*c*. An agitating shaft 18 is provided within the shutter 215 and extends in a longitudinal direction of the shutter 215. The agitating shaft 18 is rotatably supported at its one end by the boss A and rotatably supported at its another end by a bearing H inserted into the shutter 215. A cap 215*a* is fitted to one longitudinal end of the shutter 215, closing the shutter 215 to prevent the toner from leaking.

A sensor lever 21 is supported at a fulcrum 21*a* on the outer wall of the shutter 215 near the cap 215*a* in such a way that the sensor lever 21 can rock on the fulcrum 21*a*. The shutter lever 210 is fitted over the shutter 215 to form a space 200*b* that accommodates the sensor lever 21 therein. The shutter lever 210 is formed with a window 210*a*. The sensor lever 21 has a magnet 22 attached to one longitudinal end of the sensor lever 21 and a reflection plate 23 attached to another longitudinal end. When the agitating shaft 18 rotates so that a crank 18*b* approaches the magnet 22, the sensor lever 21 rocks and therefore the reflection plate 23 moves out of alignment with the window 210*a*. When the crank 18*b* rotates further to move away from the magnet 22, the agitating shaft 18 no longer attracts the magnet 22 so that the reflection plate 23 moves back into alignment with the window 210*a*. The sensor lever 21, magnet 22, reflecting plate 23, and agitating shaft 18 form a remaining toner detecting mechanism.

Figure 4A:
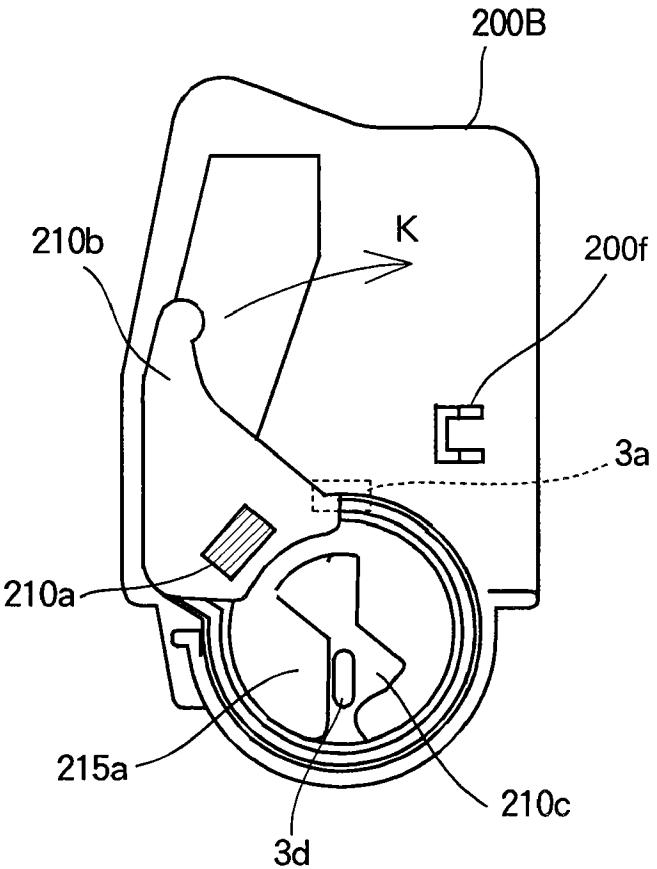

FIGS. 4A and 4B illustrate the positional relation between the rotational position of the shutter lever 210 and a window 3*a* in the frame 3 of the main body. FIG. 4A shows the positional relation immediately after the toner cartridge 200B has been attached to the image-forming section but the shutter lever 210 has not been pivoted yet. FIG. 4B shows the positional relation immediately after the shutter lever 210 has been pivoted in a direction shown by arrow K in FIG. 4A. It should be noted that when the shutter lever 210 is pivoted, the reflection plate 23 also pivots together with the window 210*a* formed in the shutter lever 210.

Referring to FIG. 4A, a projection 3*d* on the image-forming section side enters a recess 210*c* in the cap 215*a* to serve as a guide. At this moment, the window 210*a* has not yet been aligned with the toner sensor 25 provided on the frame 3. When an operating handle 210*b* is rotated in a direction shown by arrow K until the operating handle 210*b* abuts a stopper 200*f*, the window 210*a* becomes aligned with the toner sensor 25 on the frame 3 through the window 3*a*.

When the shutter lever 210 is at a position in FIG. 4B, the toner is discharged from the toner cartridge 200B through openings 200*g* (FIG. 6) while at the same time the toner cartridge 200B is attached to the image-forming apparatus completely. Thus, the toner sensor 25 emits light to the reflection plate 23 and receives the light reflected back from the reflection plate 23, thereby detecting a remaining amount of toner. If the toner cartridge 200B is attached incompletely to the image-forming apparatus, or if the operation handle 210*b* is not at the position in FIG. 4B, the reflection type toner sensor 25 cannot receive normally the light reflected back from the reflection plate 23. By using this fact, it is possible to detect whether the toner cartridge 200B has been attached to the image-forming section properly or improperly. With the operation handle 210*b* positioned at the position in FIG. 4B, rotating the agitating shaft 18 causes the crank 18*b* to first approach and then move away from the magnet 22 alternately, so that the output of the toner sensor 25 cycles on and off. If the output of the toner sensor 25 do not cycle on and off for a predetermined period of time, it is determined that the toner cartridge 200B has not been attached normally. Even when the toner cartridge 200B has been attached to the image-forming apparatus, if the shutter lever 210*b* is at the position in FIG. 4A, the light emitted from the toner sensor 25 is reflected by part of the shutter lever 210 and the toner cartridge 200B back to the toner sensor 25. Thus, only a part of the reflected light enters the toner sensor 25 and therefore the output of the toner sensor 25 does not cycle on and off. When the toner cartridge 200B has not been attached to the image-forming apparatus, the toner sensor 25 receives little or no light reflected back from the shutter lever 210. Thus, the output of the toner sensor 25 remains off. As described above, the use of the repetitive and sufficient changes in the output of the toner sensor 25 allows informing of incomplete attachment or absence of the toner cartridge 200B to the operator. The output of the toner sensor 25 may also be directly used as an alarm output.

Figure 5:
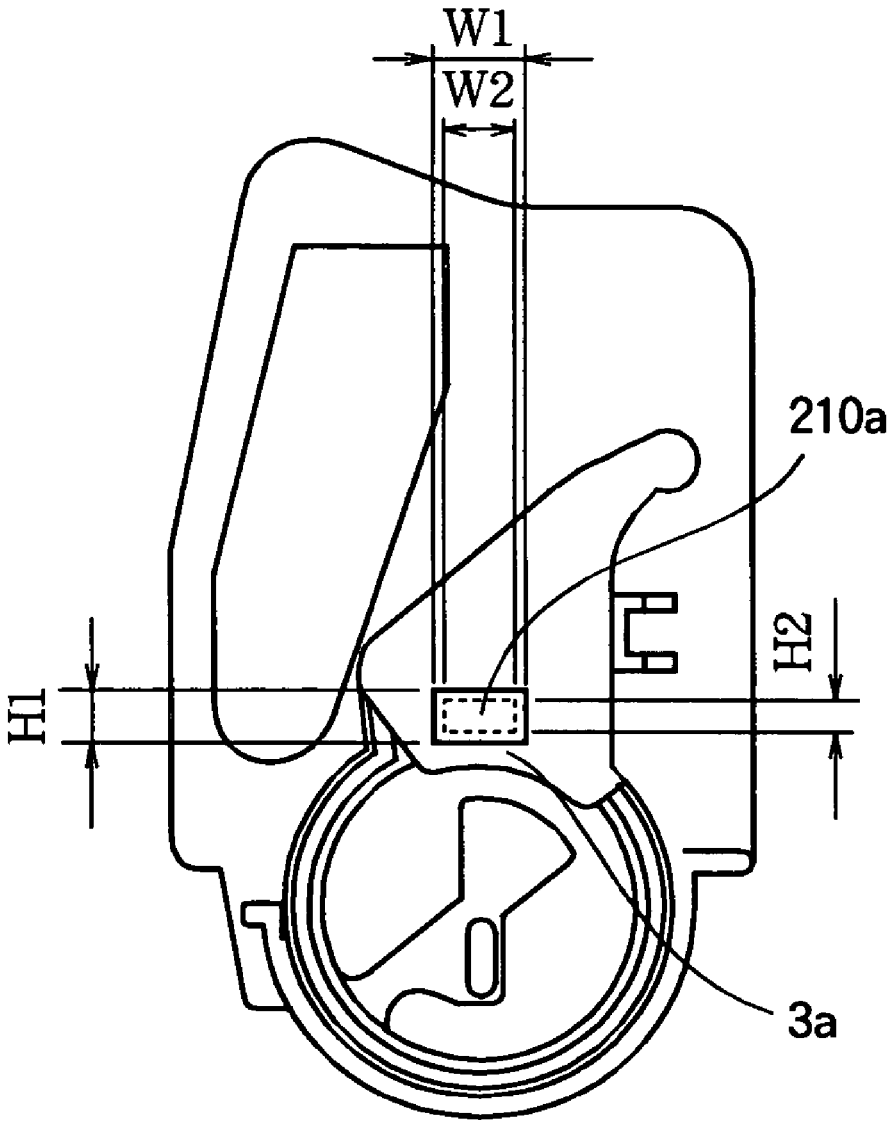
FIG. 5 illustrates a window formed in the toner cartridge and the window in the frame of the main body when they are aligned with each other.

FIG. 5 illustrates the window 210*a* and the window 3*a* when they are aligned with each other. For color image formation, the image-forming apparatus uses a plurality of colored toners. In order to prevent an unaccepted toner cartridge from being attached to the image-forming section, the outer wall of the toner cartridge may have the same color as the toner in the toner cartridge 200B. However, care should be taken in coloring the outer wall of the toner cartridge so that the colored outer surface of the toner cartridge does not affect the output of the toner sensor 25. The color of the frames 3 and 4 of the main body of the image-forming is selected regardless of the color of the toner in the toner cartridge 200B, and therefore may affect the output of the toner sensor 25.

In order that the color of the outer wall of the toner cartridge does not affect the amount of the light reflected back from the reflection plate 23 of the sensor lever 21 significantly, the window 3*a* formed in the frame 3 is made small. In other words, heights H1 and H2 and widths W1 and W2 are related such that H1>H2 and W1>W2. If the window 210*a* and the window 3*a* have a circular shape, then the diameter of the window 210*a* and the diameter of the window 3*a* are selected such that the diameter of the window 210*a* is greater than the diameter of the window 3*a*.

Because the sensor lever 21 is mounted on the outer wall of the shutter 215, the remaining amount of toner can be detected while at the same time the toner cartridge 200B is sealed against the environment. The use of a reflection type sensor allows detection of the remaining amount of toner with the toner sensor 25 and sensor lever 21 not in physical contact with each other. As opposed to a transmission type sensor, the toner sensor 25 of reflection type eliminates the need for employing a blocking plate that projects from the sensor lever 21 to block the light path. Therefore, the use of a reflection type sensor facilitates mounting and dismounting of the image-forming section on which the toner cartridge is attached. In addition, the use of a reflection type sensor also facilitates mounting of the toner cartridge to the image-forming section and dismounting the toner cartridge from the image-forming section.

Because the detection of a remaining amount of toner can be accomplished by using light, the detection result is free from electromagnetic problems. Therefore, the frames 3 and 4 on the main body of the image-forming apparatus may be manufactured from any suitable materials. In the present embodiment, the aforementioned remaining toner detecting mechanism is provided on the toner cartridge side. Instead, a combination of the agitating shaft 18 and the reflection type toner sensor 25 with the developing unit allows detection of the remaining amount of toner in the developing unit.

The remaining toner detecting mechanism will be described in more detail.

Figure 6:
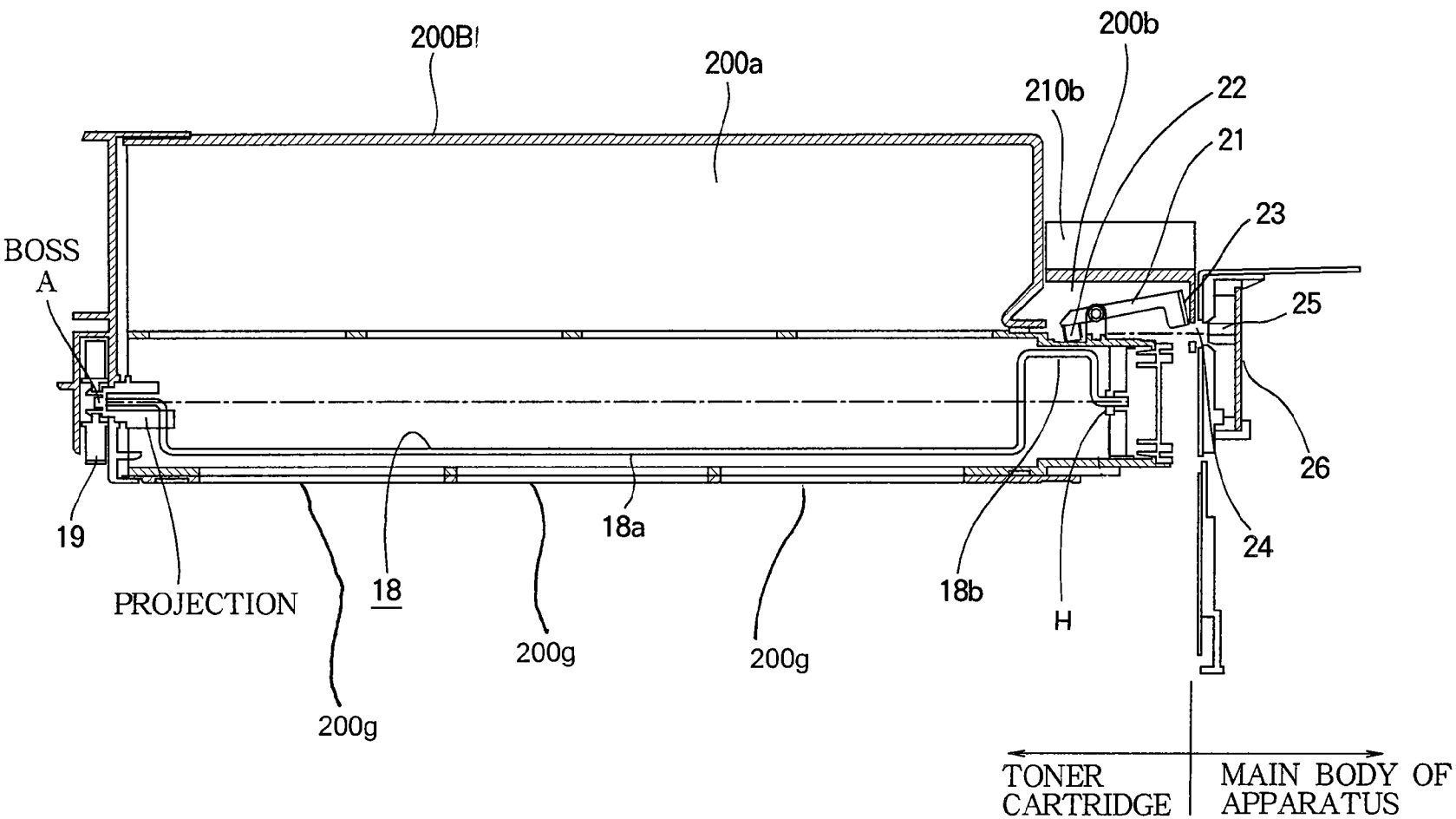
FIG. 6 illustrates a reflection plate and a toner sensor when the reflection plate of the sensor lever does not directly oppose the toner sensor.
Figure 7:
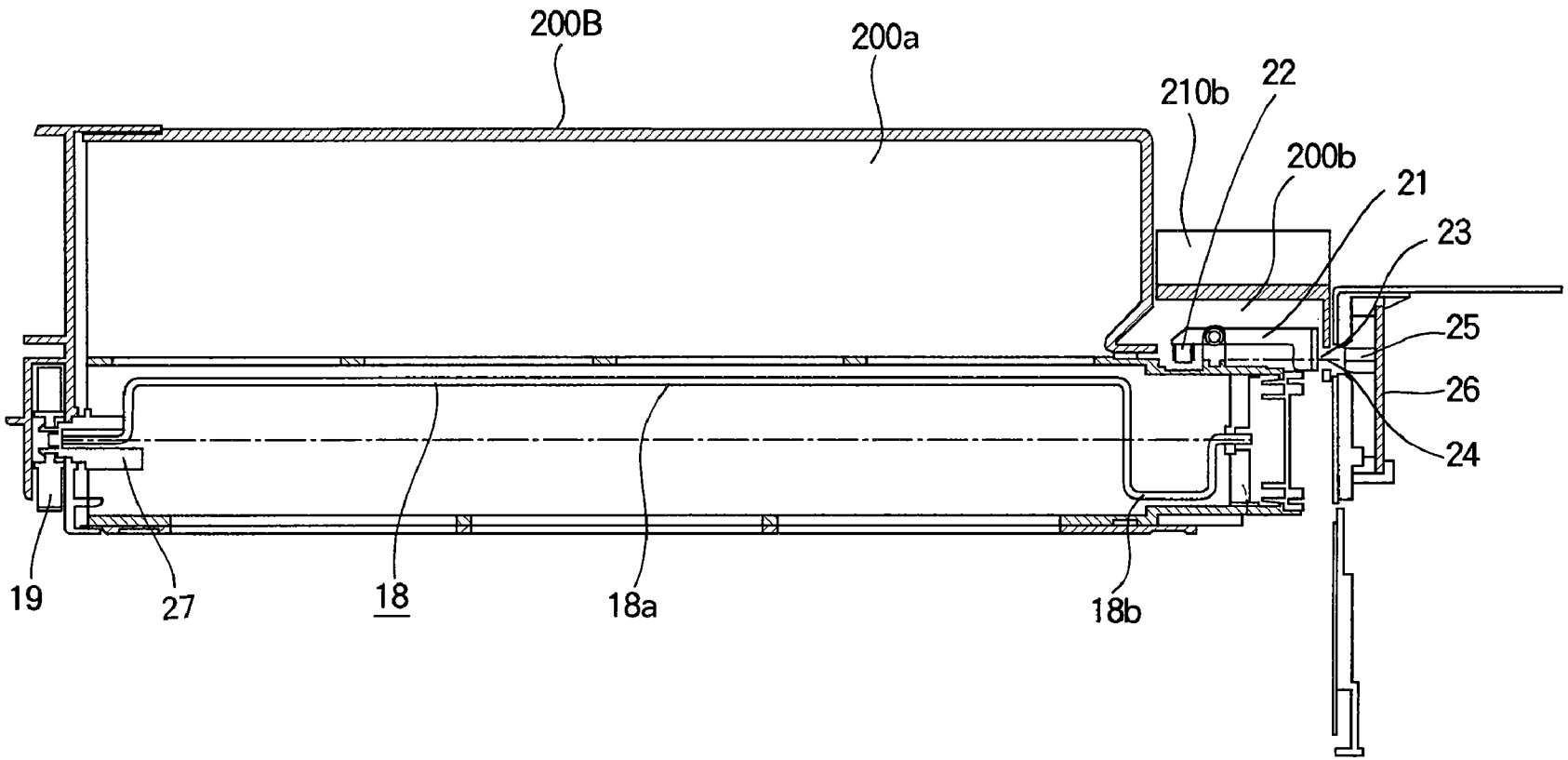
FIG. 7 illustrates the reflection plate and the toner sensor when the reflection plate of the sensor lever directly opposes the toner sensor.

FIGS. 6 and 7 are longitudinal cross-sectional views.

Figure 8:
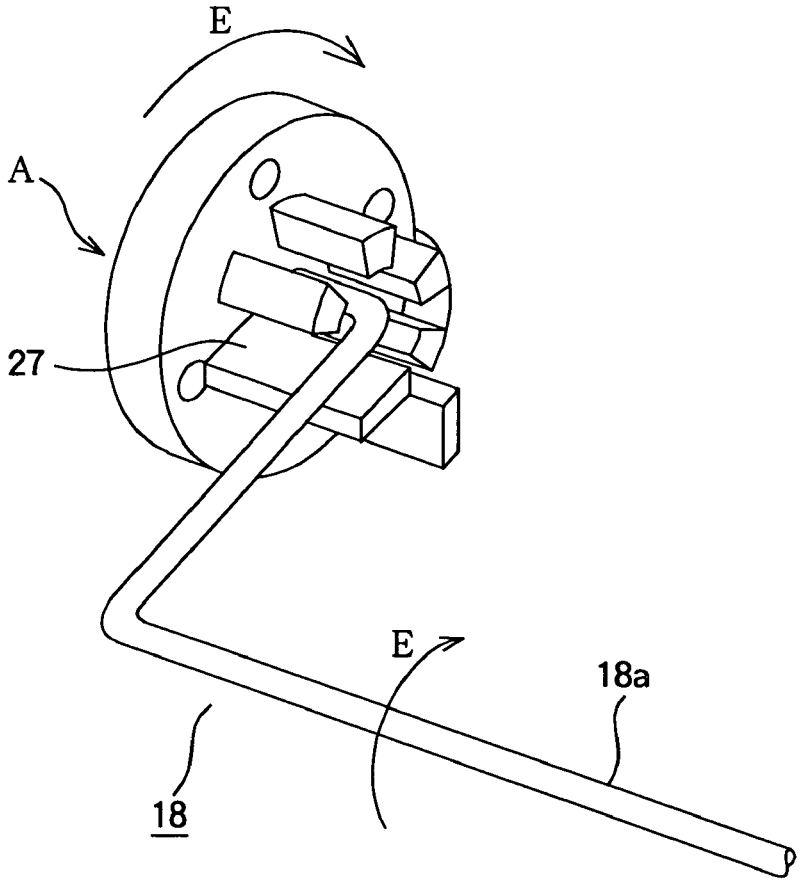
FIG. 8 illustrates the detailed engaging relation between an agitating shaft and a projection of a boss.

FIG. 8 illustrates the engaging relation between the agitating shaft 18 and a projection 27 of the boss A in FIGS. 6 and 7.

For purposes of this discussion, reference will be made to the remaining toner detecting mechanism for black, but it will be apparent that the discussion is applicable to any of the remaining toner detecting mechanisms for toners of other colors.

FIG. 6 illustrates the reflection plate 23 and the toner sensor 25 when the reflection plate 23 of the sensor lever 21 does not directly oppose the toner sensor 25.

FIG. 7 illustrates the reflection plate and the toner sensor when the reflection plate of the sensor lever directly opposes the toner sensor.

FIG. 8 illustrates the detailed engaging relation between the agitating shaft 18 and the projection of the boss A.

The toner sensor 25 emits light to the reflection plate 23 and receives the light reflected back from the reflection plate 23. The toner cartridge 200B of black includes a toner chamber 200*a* and the space 200*b* for accommodating the lever sensor 21. The toner chamber 200*a* extends longitudinally and has the agitating shaft 18 that extends in the toner chamber 200*a* along the length of the toner chamber 200*a*. The agitating shaft 18 is formed of a ferromagnetic material and includes a first crank 18*a* and a second crank 18*b*. The rotating boss A is disposed at one longitudinal end of the toner chamber 200*a* and the bearing H is disposed at the other longitudinal end. The agitating shaft 18 is supported at one end by the boss A and at its another end by the bearing H, being free to rotate. When the boss A is driven in rotation by an external drive source, not shown, the projection 27 of the boss A abuts the first crank 18*a* of the agitating shaft 18, pushing the agitating shaft 18 to rotate.

The first crank 18*a* has a longer longitudinal length than the second crank 18*b* and is therefore heavier than the second crank 18*b*. Because the agitating shaft 18 is supported for free rotation, when the first crank 18*a* is rotated together with the boss A past the top dead center, the first crank 18*a* begins to fall on the pile of toner. When a small amount of toner remains in the toner chamber 200*a*, the first crank 18*a* falls near the bottom dead center after passing the top dead center and stays near the bottom dead center until the first crank 18*a* is driven again in rotation by rotating boss A.

The space 200*b* in the toner cartridge 200B houses the sensor lever 21 that cooperates with the agitating shaft 18 to detect the remaining amount of toner in the toner chamber 200*a*. The sensor lever 21 is adapted to rock. The sensor lever 21 has the magnet 22 at its one end and the reflection plate 23 at its another end. When the agitating shaft 18 rotates so that the second crank 18*b* approaches the magnet 22, the magnet 22 is attracted to the second crank 18*b* by the magnetic force. Thus, the sensor lever 18 takes up the position as shown in FIG. 6 so that the reflection plate 23 opens the window 24.

As the agitating shaft 18 further rotates, the magnetic force no longer acts between the second crank 18*b* and the magnet 22. Thus, the sensor lever 21 takes up the position as shown in FIG. 7, the reflection plate 23 closes the window 24 formed in the toner cartridge 200B. On the main body, the toner sensor 25 and a sensor board 26 are mounted at a position where the toner sensor 25 faces the window 24.

While the agitating shaft 18 rotates, the sensor lever 21 continues to perform rocking motion. The sensor lever 21 rocks between a reflection position (FIG. 7) where the reflection plate 23 closes the window 24 to reflect the light emitted from the toner sensor 25 and a non-reflection position (FIG. 6) where the reflection plate 23 does not reflect the light emitted from the toner sensor 25. The toner sensor is of reflection type and outputs a detection signal having different levels for when the reflection plate 23 reflects the light and when the reflection plate 23 does not reflect the light.

{Detecting a Remaining Amount of Toner}

The operation of detecting a remaining amount of toner will be described.

Figure 9:
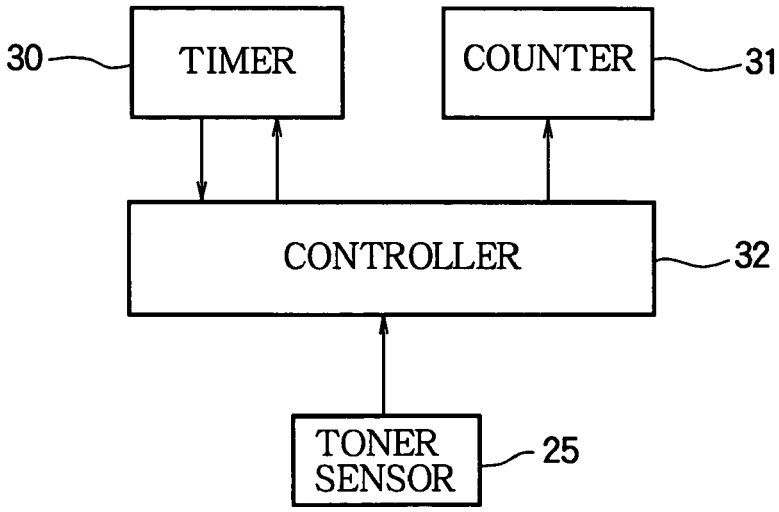
FIG. 9 illustrates a control block diagram of an image-forming apparatus according to the present invention.

FIG. 9 illustrates a control block diagram of the image-forming apparatus according to the present invention.

FIGS. 10A–10D illustrate the operation of the crank when a large amount of toner remains.

Figure 11A:
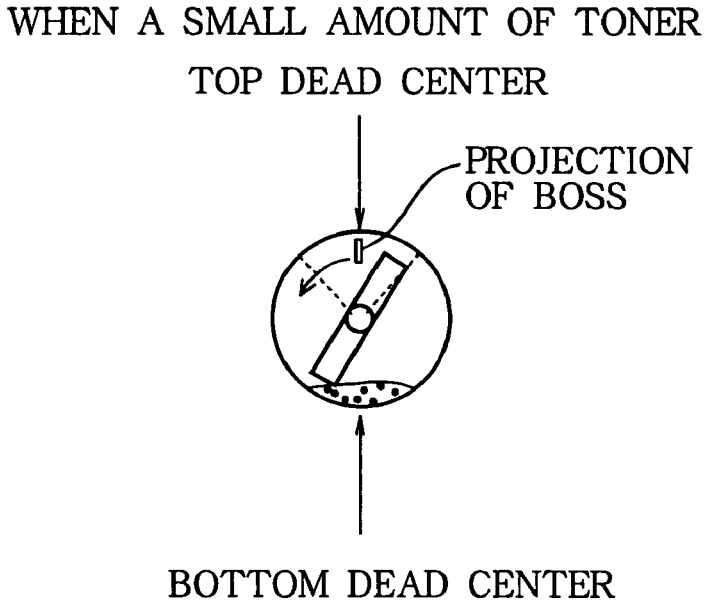
FIGS. 11A–11C illustrate the operation of first and second cranks when a small amount of toner remains in the tone chamber.
Figure 11B:
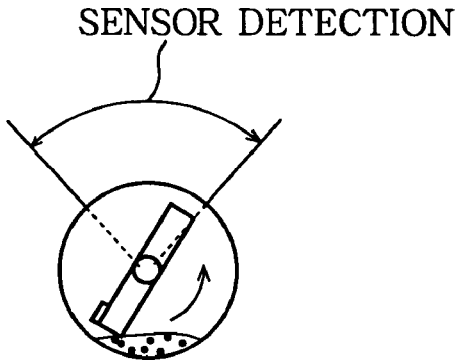
Figure 11C:
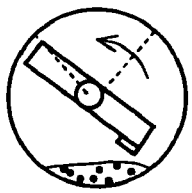

FIGS. 11A–11C illustrate the operation of the first and second cranks 18*a* and 18*b* when a small amount of toner remains in the tone chamber 200*a*.

Figure 12:
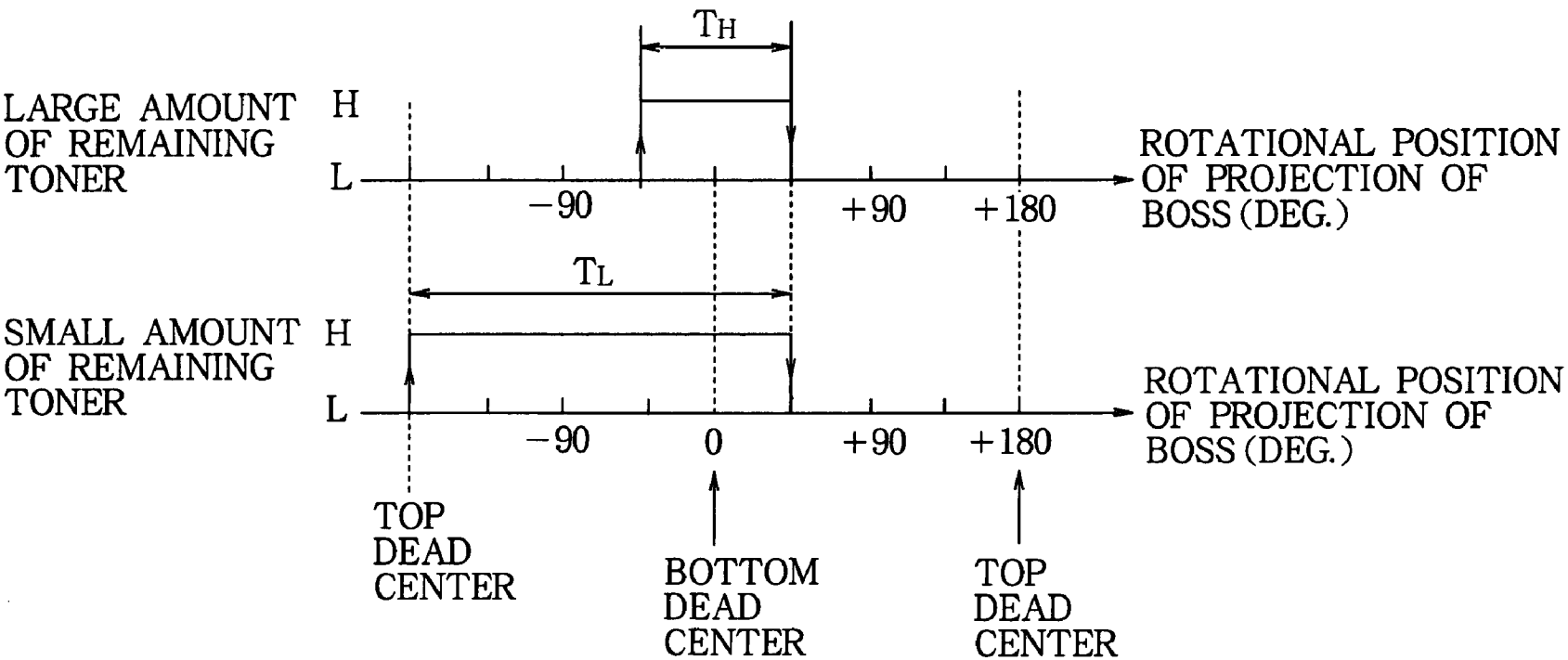
FIG. 12 illustrates the relation between an output of the toner sensor and the rotational position of the first crank for both when a large amount of toner remains in the toner chamber and when a small amount of toner remains in the toner chamber.

FIG. 12 illustrates the relation between the output of the toner sensor 25 and the rotational position of the first crank 18*b* for both when a large amount of toner remains in the toner chamber 200*a* and when a small amount of toner remains in the toner chamber 200*a*.

Figure 10A:
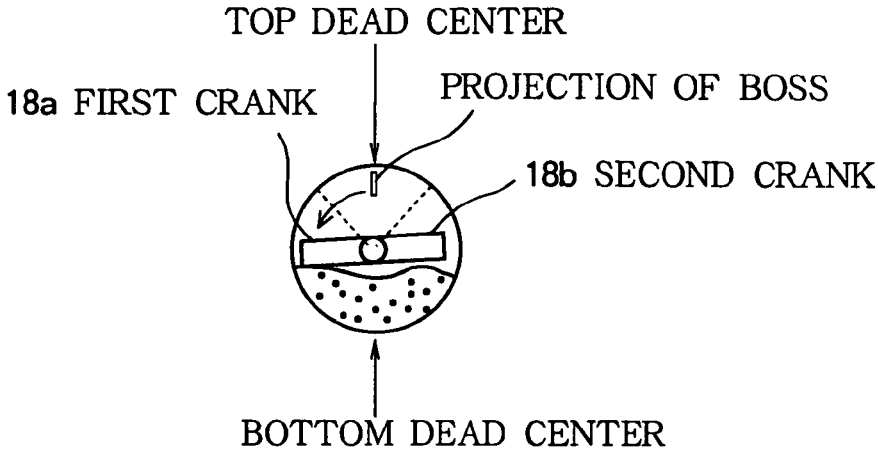
FIGS. 10A–10D illustrate the operation of a crank when a large amount of toner remains in the toner chamber.

The operation of detecting a large amount of remaining toner will be described with reference to FIGS. 10A–10D and FIG. 12. When the first crank 18*a* of the agitating shaft 18 is pushed by the projection 27 of the boss A to rotate past the top dead center, the first crank 18*a* falls onto the pile of toner due to its own weight, so that the agitating shaft 18 quickly rotates. Thereafter, the first crank 18*a* stays on the pile of toner until the projection 27 of the boss A, which is rotating at a constant angular speed, pushes the first crank 18*a* again. At the position as shown in FIG. 10A, the second crank 18*b* has not arrived at the detection region (the magnet 22 attracts the second crank 18*b*), and thus the reflection plate 23 closes the window 24 and the output of the toner sensor 25 is at a low level.

Figure 10B:
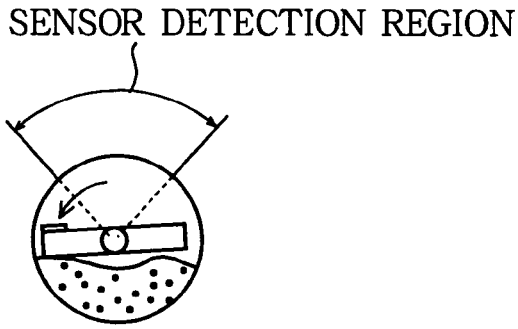
Figure 10C:
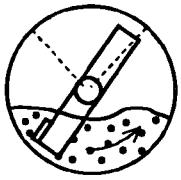
Figure 10D:
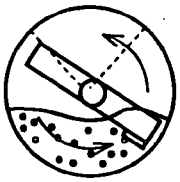

As shown in FIG. 10B, when the projection 27 of the boss A reaches the first crank 18*a*, the projection 27 pushes the first crank 18*a*, thereby starting to rotate the agitating shaft 18. The boss A continues to rotate to enter the sensor detection region depicted by dot lines. Then, the magnet 22 attracts the second crank 18*b* to cause the sensor lever 21 to rock. The sensor lever 21 allows the reflection plate 23 to open the window 24, the reflection plate 23 not reflecting the light emitted from the toner sensor 25. At this moment, the output of the toner sensor 25 is at a high level as shown in FIG. 12. Then, the first crank 18*a* is pushed by the projection 27 of the boss A that rotates at a constant velocity, and moves out of the detection region (FIG. 10D) so that the magnet 22 no longer attracts the second crank 18*b*. As a result, the sensor lever 21 rocks so that the reflection plate 23 closes the window 24 to reflect the light emitted from the toner sensor 25. The detection output of the toner sensor 25 is now at a low level as shown in FIG. 12. As described above, when a large amount of toner remains, the output of the toner sensor 25 remains shorter (TH) at a high level than at a low level.

The operation of the remaining toner detecting mechanism when a small of toner remains in the toner cartridge 200B will be described with reference to FIGS. 11A–11C and FIG. 12.

The projection 27 of the rotating boss A pushes the first crank 18*a* of the agitating shaft 18 so that the agitating shaft 18 rotates. When the first crank 18*a* rotates past the top dead center, the first crank 18*a* falls by its own weight to rotate further until the first crank 18*a* lands on the top of the pile of toner as shown in FIG. 11A. At this moment, the second crank 18*b* is within the sensor detection region and therefore the magnet 22 attracts the second crank 18*b*. Thus, the sensor lever 21 rocks so that the reflection plate 23 opens the window 24 (i.e., the reflection plate 23 does not reflect the light) and the detection output of the toner sensor 25 becomes a high level. Thereafter, the agitating shaft 18 does not rotate until the projection 27 further rotates to reach the first crank 18*a*. When the projection 27 reaches the first crank 18*a* (near the bottom dead center in FIG. 11B), the projection 27 pushes the first crank 18*a* to cause the agitating shaft 18 to rotate again. Thus, the agitating shaft 18 continues to rotate together with the projection 27. When the second crank 18*b* moves out of the detection region (FIG. 11C), the magnet 22 no longer attracts the second crank 18*b*. As a result, the sensor lever 21 rocks so that the reflection 23 closes the window 24 (i.e., the reflection plate 23 reflects the light emitted from the toner sensor 25). At this moment, the detection output of the toner sensor 25 becomes a low level as shown in FIG. 12. As described above, when the remaining amount of toner is small, the output of the toner sensor 25 remains longer at a high level than at a low level.

As described above, the magnet 22 attracts the second crank 18*b* shorter when the remaining amount of toner is large and longer when the remaining amount of toner is small. As shown in FIG. 12, regardless of whether the remaining amount of toner is large or small, the output of the toner sensor 25 transits from high level to low level at the same rotational position of the projection 27. By means of a timer 30, the controller 32 (FIG. 9) detects a time length TH during which the output of the toner sensor 25 is at a high level and a time length TL during which the output of the toner sensor 25 is at a low level.

An up/down mechanism for the image-forming section will be described.

Figure 13:
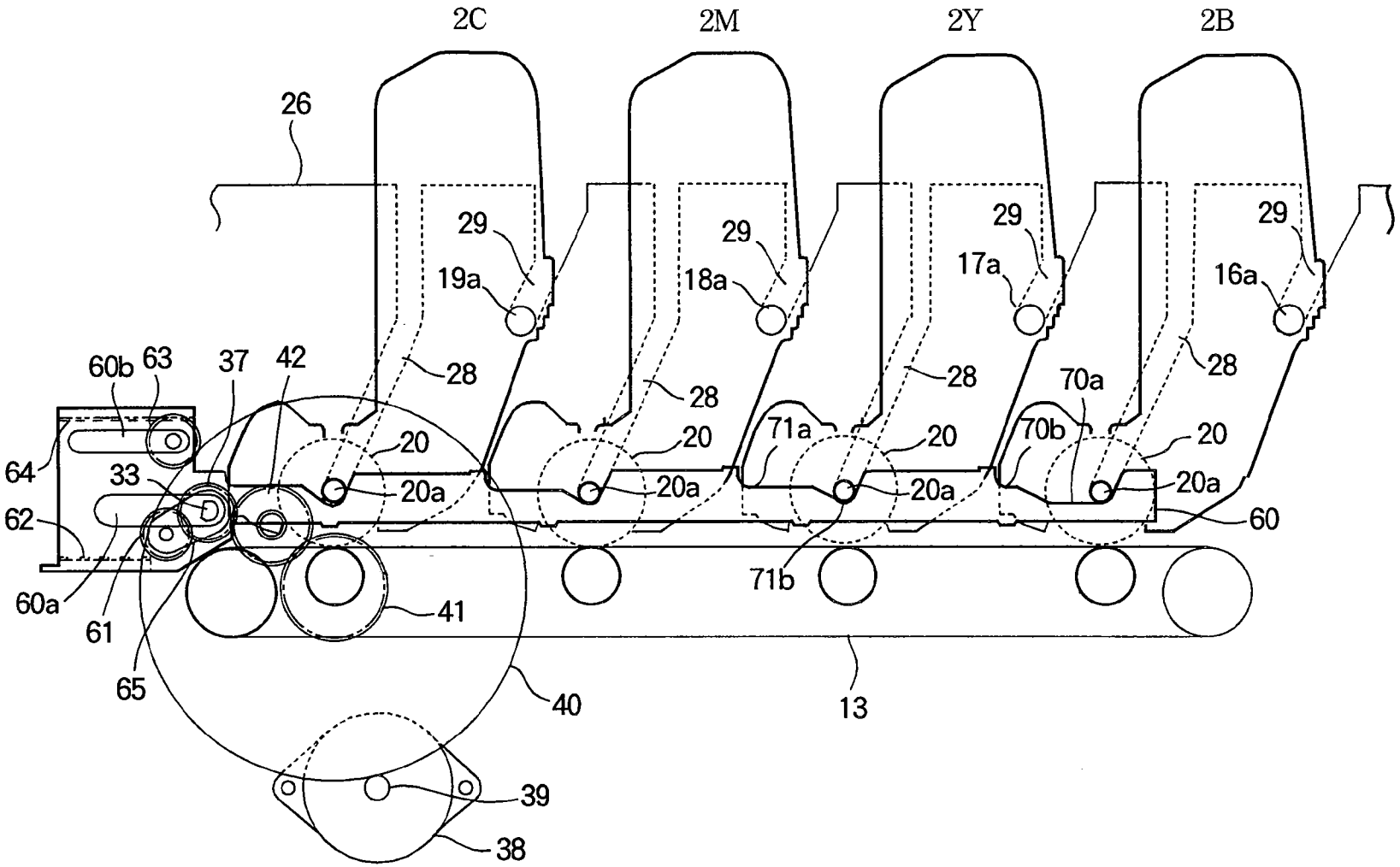
FIG. 13 illustrates an image-forming section at a down-position.

FIG. 13 illustrates an image-forming section at the down-position.

Figure 14:
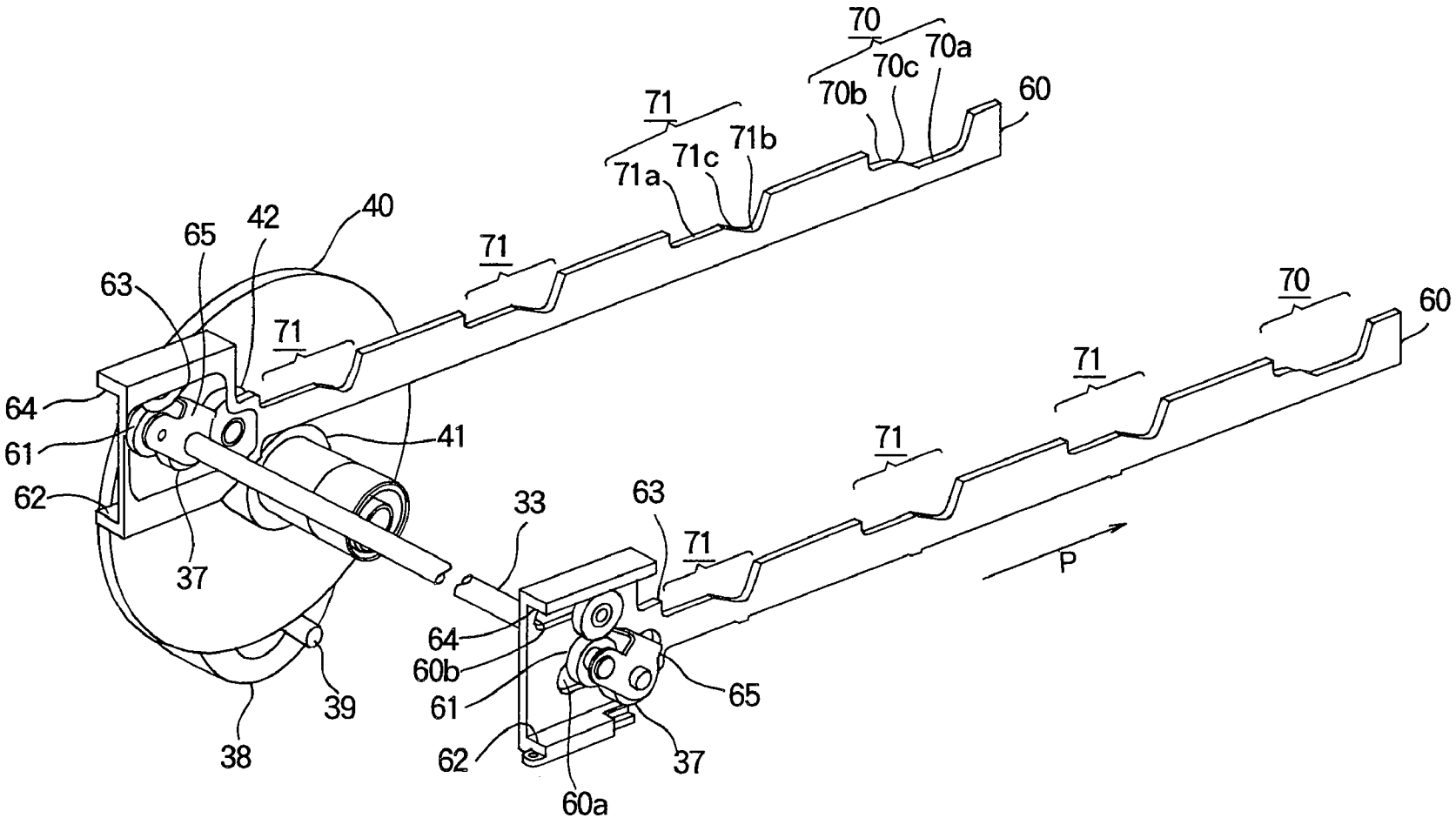
FIG. 14 is a perspective view of an up/down mechanism.

FIG. 14 is a perspective view of the up/down mechanism.

Figure 15:
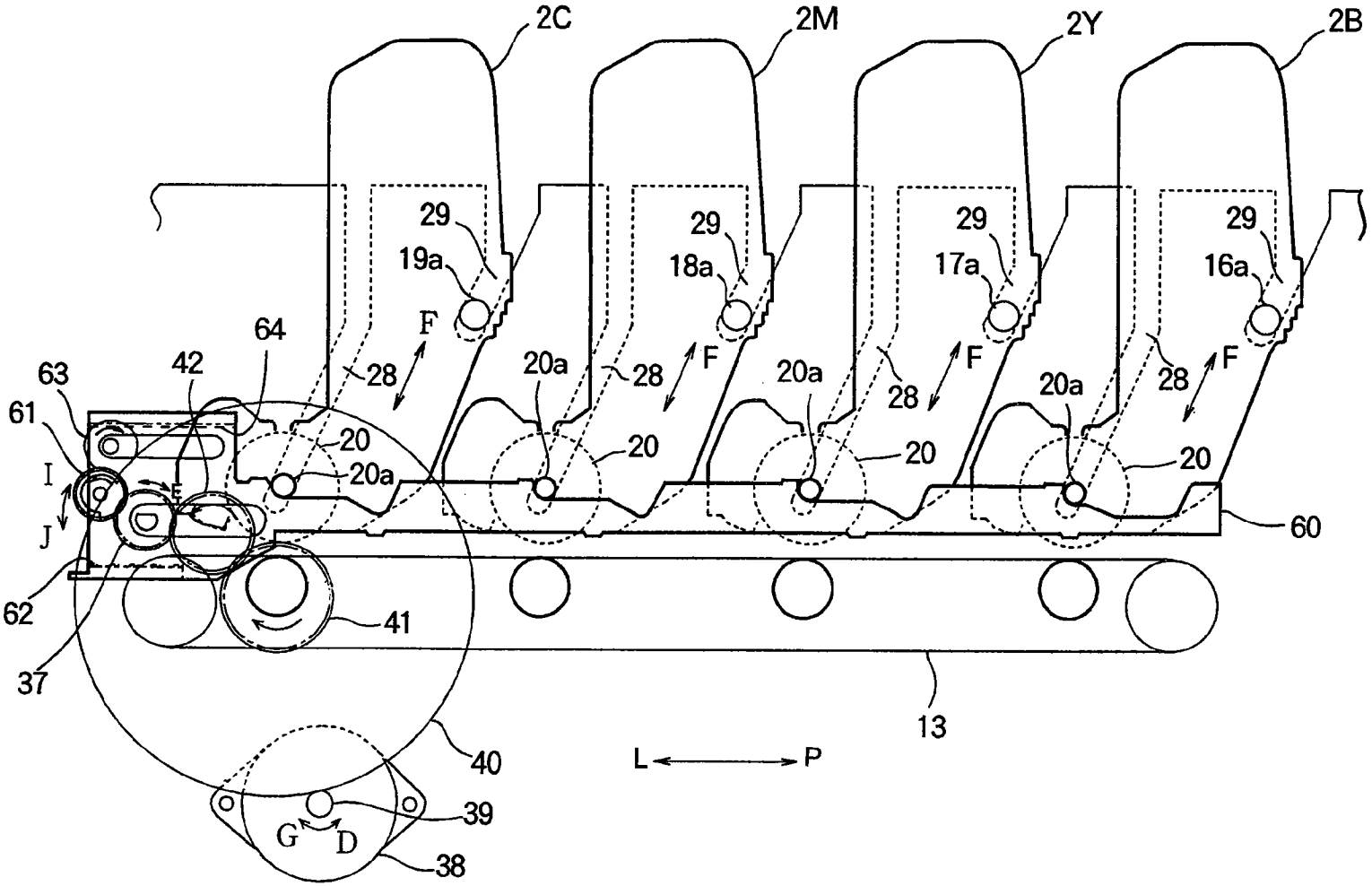
FIG. 15 illustrates the image-forming section at the up-position.

FIG. 15 illustrates the image-forming section at the up-position.

The rotational shaft 33 has gears 37 as a sun gear attached thereto and is rotatably supported at longitudinal ends by brackets 65. Slide links 60 has elongated holes 60*a* that are elongated in directions shown by arrow P and L. The rotational shaft 33 and shaft of the gears 63 extend through the elongated holes 60*a* and 60*b*, respectively. Thus, when the slide links 60 move in the P and L directions, the rotational shaft 33 and the shaft of the gears 63 do not interfere with the movement of the slide links 60.

The slide links 60 have cam surfaces 70. Each cam surface 70 has guide surfaces 70*a* and 70*b*, and an inclined surface 70*c* contiguous with the guide surfaces 70*a* and 70*b*. The cam surface 70 engages a shaft 20*a* of a photoconductive drum of the image-forming section 2B for black. The slide link 60 also has cam surfaces 71 each of which includes guide surfaces 71*a* and 71*b* and an inclined surface 71*c* contiguous with the guide surfaces 71*a* and 71*b*. The cam surfaces 71 engage shafts 20*a* of photoconductive drums of the image-forming sections (Y, M, and C) for color printing. The guide surface 70*a* is substantially flat while the guide surface 71*a* is substantially V-shaped. The guide surface 71*a* is longer in the direction of movement of the slide link 60 than the guide surface 70*b*. When the first guide surface 70*a* supports the shaft 20*a* of the photoconductive drum of the image-forming section 2B for black during color printing, the first guide surfaces 71*a* support the shafts 20*a* of the photoconductive drums of the image forming sections 2Y–2C.

When printing is not to be performed (i.e., the image forming sections are to be at the up-position), a drive motor 38 is rotated in the D direction so that a gear 39 attached to the drive motor 38 causes gears 40–42 to rotate in directions shown by arrows to cause the gear 37 to rotate in a direction shown by arrow E. The rotation of the gear 37 in the E direction causes the rotating shaft 33 and planetary gears 61 to rotate together, so that the brackets 65 rotate in a direction shown by arrow I into meshing engagement with the rack 64. This causes the slide links 60 to slide by a predetermined distance in the P direction.

Referring to FIG. 15, when the slide links 60 slide in the P direction, the image-forming sections 2B, 2Y, 2M, and 2C, the shafts 20*a* of the photoconductive drums are guided on the cam surface 71 and in the guide groove 28 indirections shown by arrow F. At this time, shafts 16*a*–19*a* projecting from the walls of image-forming sections 2b, 2Y, 2M, and 2C are also guided in grooves 29, respectively. As a result, the image-forming sections 2B, 2Y, 2M, and 2C are lifted by a predetermined distance from the transport belt 13 to the up-position.

The drive motor 38 is stopped at a position where the shafts 20*a* are supported on the guide surfaces 70*b* of the cam surfaces 70 and on the guide surfaces 71*a* of the cam surfaces 71. Thereafter, a holding current is supplied to the drive motor 38, thereby holding the slide links 60 at this position.

In black only printing, the drive motor 38 is rotated in a direction shown by arrow G, the rotational shaft 33 and planetary gears 61 rotate together and the brackets 65 rotate in a direction shown by arrow J, so that the planetary gears 61 move into meshing engagement with the racks 62 to cause the slide links 60 to move by a predetermined distance in the direction shown by arrow L.

When the sliding links 60 slide in the direction shown by arrow L, the shaft 20*a* of the photoconductive drum of the image forming section 2B for black is supported on the first guide surface 70*a*, and the shafts 20*a* of the photoconductive drums of the image forming sections 2Y, 2M, and 2C for color printing are supported on the second guide surfaces 71*a*. At this moment, the drive motor 38 is stopped and then an appropriate amount of current is supplied into the drive motor 38, so that the sliding links 60 are held at this position (i.e., down-position of the image forming section for black only printing) Thus, the photoconductive drum 20 of the image forming section for black only printing is in pressure contact with the transfer belt 13 while the photoconductive drums 20 for the image-forming sections 2Y, 2M, and 2C for color printing. With this condition, black only printing can be performed.

For color printing, the slide links 60 are further moved in the L direction. When the slide links 60 has slid to a position where the shaft 20*a* of the photoconductive drum of the image forming section for black is supported on the guide surface 70*a* and the shafts 20*a* of the photoconductive drums of the image forming sections for color printing are supported on the guide surfaces 71*b*, the drive motor 38 is stopped. Thereafter, an appropriate amount of current is run through the drive motor 38, so that the sliding links 60 are held at this position (i.e., the down-position of the image forming sections for color printing). Thus, the photoconductive drums 20 of all the image forming sections are in pressure contact with the transfer belt 13, enabling color printing.

{Detecting Upward and Downward Movements of Image-Forming Sections}

Detection of the up-position and down-position of the image-forming sections will be described. As long as the slide links 60 are normally moved, the respective image-forming sections 2B, 2Y, 2M, and 2C are placed at the up and down positions. If some trouble happens, even though the slide links 60 slide to a predetermined position, the respective image forming sections may not be positioned properly. This implies that it is necessary to check whether the image-forming sections have been positioned properly every time they are moved to the up-position or down-position. For example, if a service man fails to replace the image-forming sections to the normal positions after maintenance operations, an alarm may be outputted.

The toner sensor 25 on the main body side receives the light reflected back from the reflection plate 23, thereby detecting the upward and downward movements of the image-forming sections to determine whether the image-forming sections are at the up-position or down-position. The outer wall structure of the image-forming section serves as a low-reflection area.

Figure 16:
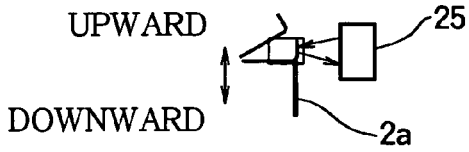
FIG. 16 illustrates the reflection having a high reflectivity (e.g., bright color) and an outer wall having a low reflectivity (e.g., dark color) immediately adjacent to the reflection plate.

FIG. 16 illustrates the reflection plate 23 having a high reflectivity (e.g., bright color) and an outer wall 2*a* having a low reflectivity (e.g., dark color) immediately adjacent to the reflection plate 23.

Figure 17A:
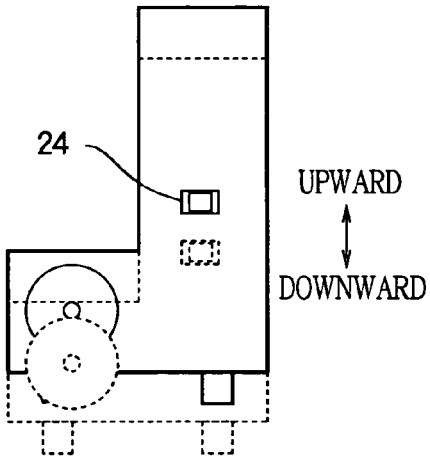
FIG. 17A is a side view of the image-forming section.

FIG. 17A is a side view of the image-forming section.

Figure 17B:
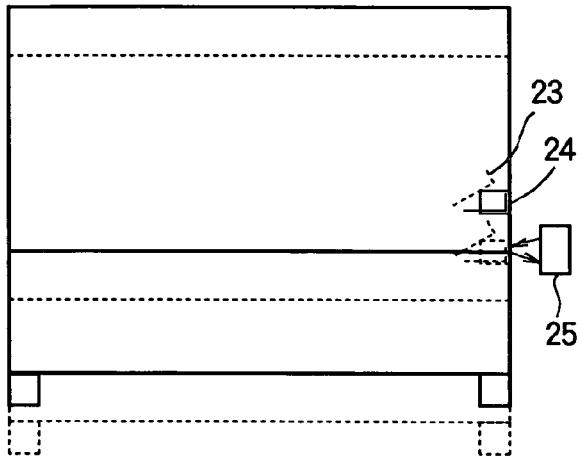
FIG. 17B is a front view of the image-forming section.

FIG. 17B is a front view of the image-forming section.

FIGS. 17A and 17B illustrate the image forming section in dotted lines when it is at the down position, and in solid lines when it is at the up position.

The toner sensor 25 is fixed on the main body.

The outer wall 2*a* may be molded of a low-reflectivity material containing a black paint (e.g., N1.5 in the Munsell color system). Alternatively, the outer wall 2*a* may be painted with a dull black paint, though somewhat costly. A non-reflective seal may be adhered only to an area on the outer wall 2*a* to be detected by the toner sensor 25. When the image-forming section moves from the down-position to the up-position, the toner sensor 25 detects a change in light from a bright color to a dark color. When the image-forming section moves from the up-position to the down-position, the toner sensor 25 detects a change in light from the dark color to the bright color.

{Controlling Upward and Downward Movements of Image-Forming Sections}

The control of the upward and downward movements of the image-forming sections will be described.

The up/down control of the image-forming sections in the present embodiment is subjected to the following constraints. The sensor lever 21 is driven to rock by a motor that drives the image-forming section. Due to variations in the remaining amount of toner and dimensional errors of the mechanism, the reflection plates 23 of the image-forming sections are driven at slightly different timings. Thus, in the present embodiment, when the image-forming sections for color printing are raised from and lowered onto the transfer belt 13, the movement of a selected one of the image-forming sections is detected. The image-forming section for black only printing is moved upward and downward at different timings from the image-forming sections for color printing. That is, in the upward movement, the color image-forming sections are first moved to the up-position and then the image-forming section for black only printing is moved to the up-position. In the downward movement, the color image-forming section for black only printing is first moved to the down-position and then the image-forming section for color printing are moved to the down-position.

{Upward Movement of Image Forming Section}

The control of the upward movement of the image-forming sections will be described. The drive motor of the image-forming section 2C is rotated in the reverse direction prior to black only printing, so that the slide links 60 slide by a predetermined distance in the P direction in FIG. 15 to move the image-forming sections for color printing to the up-position.

Each of the image-forming sections has the window 24 formed in the side walls. The rotation of the agitating shaft 18 causes the sensor lever 21 so that the reflection plate 23 opens and closes the window 24. Prior to the upward movement, the drive motor is rotated until the reflection plate 23 has moved to a position where the reflection plate 23 closes the window 24. When the reflection plate 23 closes the window 24 completely, the drive motor is stopped. At this position of the reflection plate 23, the light emitted from the toner sensor 25 is reflected by the reflection plate 23 back to the toner sensor 25. Then, the drive motor for the image-forming section 2C for cyan is rotated in the reverse direction, thereby initiating the upward movement of the image forming sections. As the image-forming section 2C moves upward further, the reflection plate 23 moves away from the path of light emitted from the toner sensor 25 and the outer wall 2*a* of the image-forming section appears on the path of light emitted from the toner sensor 25. Because the reflectivity of the outer wall 2*a* is low, the amount of light incident on the toner sensor 25 is small. In other words, when the image-forming section moves from the down-position to the up-position, the toner sensor 25 detects a change of light from a bright color to a dark color. As a result, the output of the toner sensor 25 is at a low level, indicating that the upward movement of the image-forming section has been completed.

When the image-forming section is moved to the up-position, the drive motor of the image-forming section for black is rotated in the forward direction until the reflection plate 23 of the image-forming section for black closes the window 24. When the reflection plate 23 has closed the window 24 completely, the drive motor is stopped. Thereafter, just as in the upward movement of the image-forming sections for color printing, the motor for the image-forming section for cyan is rotated in the reverse direction, thereby moving the image-forming section for black to the up-position.

Figure 18A:
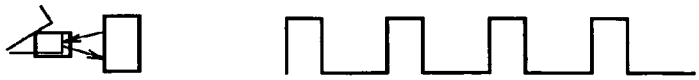
FIG. 18A illustrates the output of the toner sensor when the image-forming section is at the down-position.

FIG. 18A illustrates the output of the toner sensor 25 when the image-forming section is at the down-position.

As the agitating shaft 18 rotates, the reflection plate 23 repeats rocking motion to open and close the window 24. Thus, the toner sensor 25 detects the light reflected back from the reflection plate 23, causing the output of the toner sensor 25 to switch between a high level and a low level.

Figure 18B:
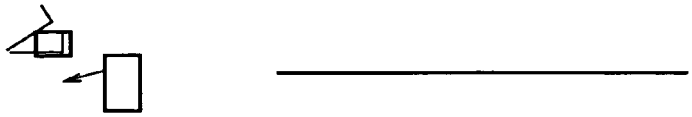
FIG. 18B illustrates the output of the toner sensor when the image-forming section is at the up-position.

FIG. 18B illustrates the output of the toner-sensor 25 when the image-forming section is at the up-position.

The window 24 is sufficiently above the path of light emitted from the toner sensor 25 and therefore the toner sensor 25 does not detect the light reflected back from the reflection plate 23, the output of the toner sensor 25 remaining at a low level.

{Downward Movement of Image Forming Section}

The control of the downward movement of the image-forming sections will be described. When only the image-forming section for black is to be moved to the down-position, the slide links 60 are moved by a predetermined distance in the L direction in FIG. 15, thereby allowing the image-forming section for black to move to the down-position.

The image-forming section for cyan rotates in the forward direction, thereby initiating the downward movement of the image forming section. At this moment, the outer wall 2*a* of the image-forming section is in the path of light emitted from the toner sensor 25. Because the outer wall 2*a* of the image-forming section has a low reflectivity, only a small amount of light is incident on the toner sensor 25 and therefore the output of the toner sensor 25 is at a low level. The image-forming section moves further downward. Then, the reflection 23 appears in the path of the light emitted from the toner sensor 25, so that the toner sensor 25 initiates to read the light reflected back from the reflection plate 23. When the image-forming section moves still further downward, the reflection plate 23 moves away from the path of the light emitted from the toner sensor 25 and the outer wall 2*a* of the image-forming section for black appears in the path of light emitted from the toner sensor 25 again. In other words, when the image-forming section moves from the up-position to the down-position, the toner sensor 25 detects a change from a dark color to a bright color.

In other words, the order in which the output of the toner sensor 25 changes when the image-forming section for black is moved downward is reversed with respect to that when the image-forming section for black is moved upward. For downward movement, when the toner sensor 25 detects the light reflected from the reflection plate 23, the drive motor of the image-forming section for cyan will not stop immediately but continues to rotate by a predetermined number of pulses, thereby placing the image-forming section for black in position.

After the completion of the downward movement of the image-forming section for black, the image-forming sections for color printing are moved to the down-position, if necessary, while also monitoring the output waveform of the toner-sensor 25.

Figure 19A:
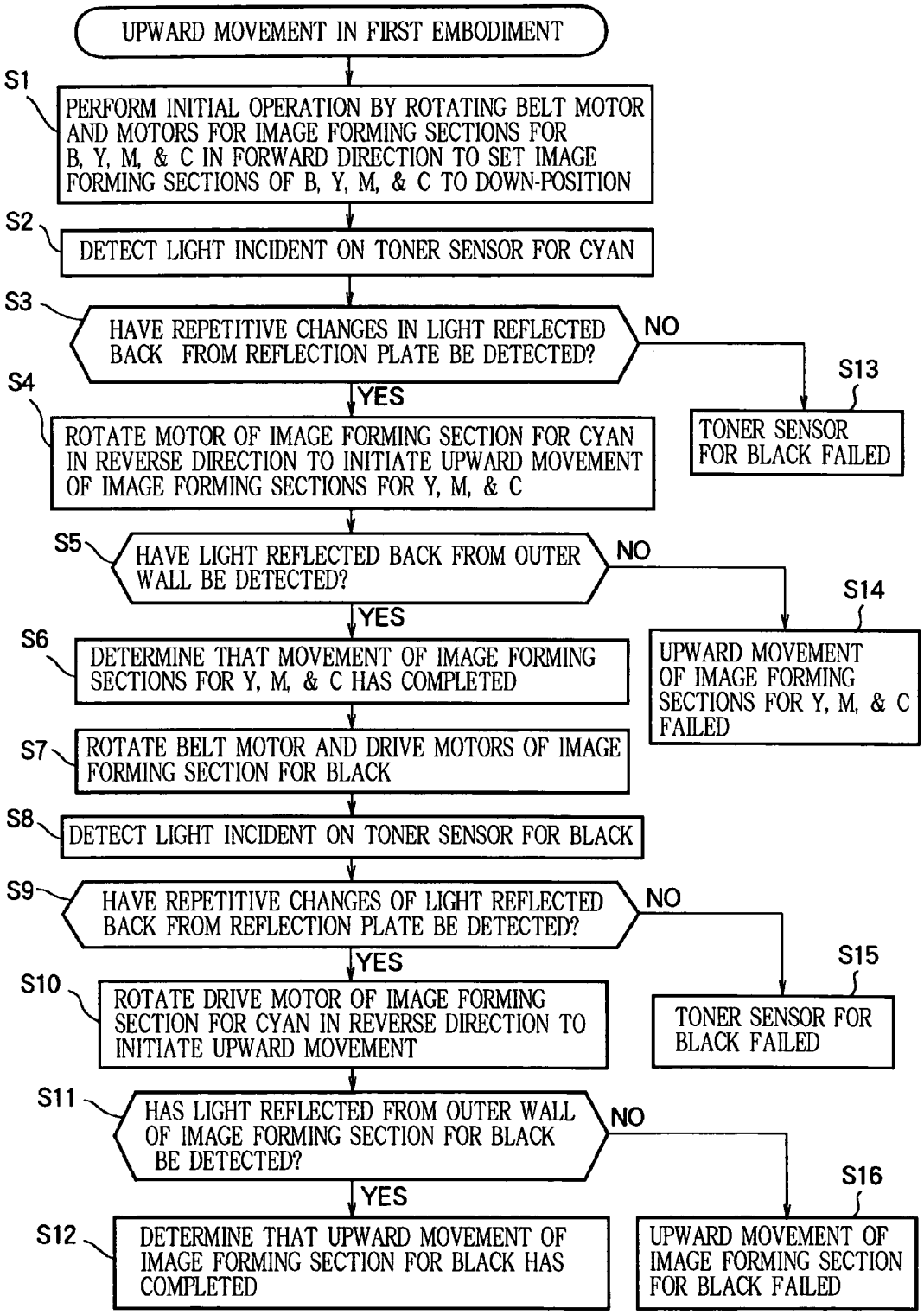
FIG. 19A illustrates the upward movement of the image-forming section.
Figure 19B:
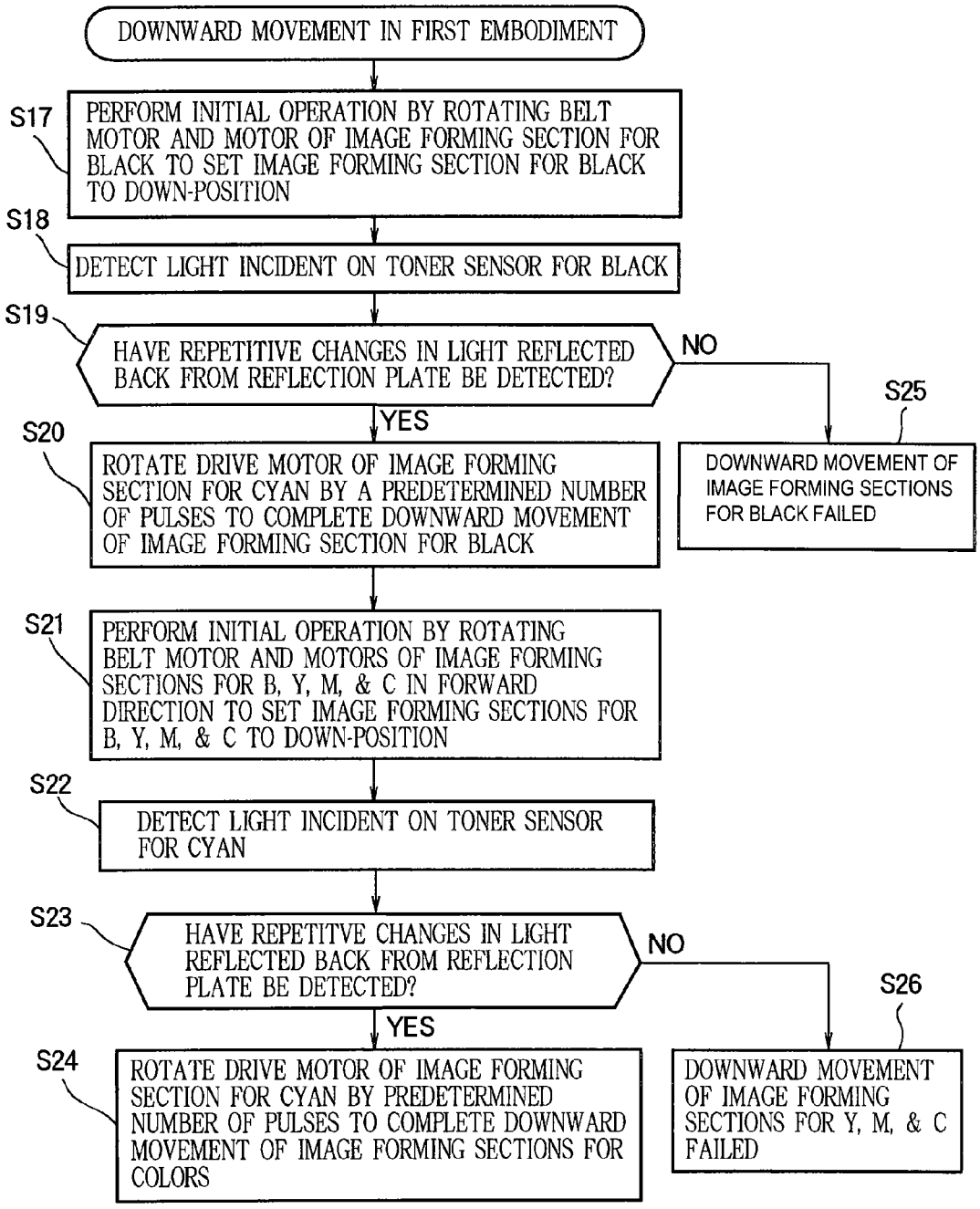
FIG. 19B illustrates the downward movement of the image forming section.

FIGS. 19A and 19B are flowcharts illustrating the operation of the first embodiment.

FIG. 19A illustrates the upward movement of the image-forming section.

The upward movement will be described with reference to FIG. 19A. At step S1, an initial operation is performed. That is, the belt and drive motors of the image forming sections for black only printing and color printing (Y, M, and C) are rotated in the forward direction, thereby placing all the image-forming sections at the down-position. At step S2, the toner sensor 25 for cyan detects the light incident thereon. At step S3, a check is made to determine whether the toner sensor 25 has detected repetitive changes (FIG. 18A) caused by the reflection plate 23. If the answer is NO, then the program proceeds to step S13. If the answer is YES, the program proceeds to step S4. At this moment, the sensor lever 21 stops at a position where the reflection plate 23 reflects the light emitted from the toner sensor 25. At step S4, the drive motor of the image-forming section for cyan rotates in the reverse direction, initiating the upward movement of the image-forming sections (Y, M, and C). At step S5, a check is made to determine whether the toner sensor 25 has detected the light (dark color) reflected back from the outer wall 2*a*. If the answer is NO, the program proceeds to step S14. If the answer is YES, the program proceeds to step S6 where it is determined that the movement of the image-forming sections for color printing has completed.

At step S7, the belt motor and the drive motor of the image-forming section for black only printing are rotated. At step S8, the toner sensor 25 for black detects the intensity of the light incident thereon. At step S9, a check is made to determine whether the toner sensor 25 has detected repetitive changes (FIG. 18A) in the amount of incident light caused by the rocking motion of the reflection plate 23. If the answer is NO, the program proceeds to step S15. If the answer is YES, the program proceeds to step S10. At this moment, the sensor lever 21 stops at a position where the reflection plate 23 reflects the light emitted from the toner sensor 25. At step S10, the drive motor of the image-forming section for cyan is rotated in the reverse direction, thereby initiating the upward movement of the image-forming section for black. At step S11, a check is made to determine whether the toner sensor 25 has detected the light (dark color) reflected back from the outer wall of image-forming section for black. If the answer is NO, the program proceeds to step S16. If the answer is YES, the program proceeds to step S12 where it is determined that the upward movement of the image-forming section for black only printing has completed.

FIG. 19B illustrates the downward movement of the image forming section.

The downward movement will be described with reference to FIG. 19B.

At step S17, an initial operation is performed. That is, the belt motor, the drive motor of the image-forming section for black, and the drive motor of the image-forming section for cyan are rotated in the forward direction, thereby initiating the downward movement of the image-forming section for black. At step S18, the intensity of the light incident on the toner sensor 25 for black is detected. At step S19, a check is made to determine whether the toner sensor 25 has detected the light reflected back from the reflection plate 23. If the answer is NO, the program proceeds to step S25. If the answer is YES, the program proceeds to step S20. At step S20, the drive motor of the image-forming section for cyan is rotated by a predetermined number of pulses in the forward direction, thereby completing the downward movement of the image forming section for black.

At step S21, an initial operation is performed. That is, the belt motor and drive motors of the image forming sections for black only printing and color printing, thereby placing all the image-forming sections at the down-position. At step S22, the intensity of the light incident on the toner sensor 25 of the image-forming section for cyan is detected. At step S23, a check is made to determine whether the toner sensor 25 has detected the intensity of the light reflected back from the reflection plate 23. If the answer is NO, the program proceeds to step S26. If the answer is YES, the program proceeds to step S24 where the image-forming section for cyan is rotated by a predetermined number of pulses in the forward direction, thereby completing the downward movement of the image-forming sections for color printing.

In order to improve the accuracy with which the up- and down-position of the image-forming sections for color printing are detected, a bar code may be provided on the surface of the reflection plate 23, thereby encoding the output of the toner sensor 25.

Figure 20:
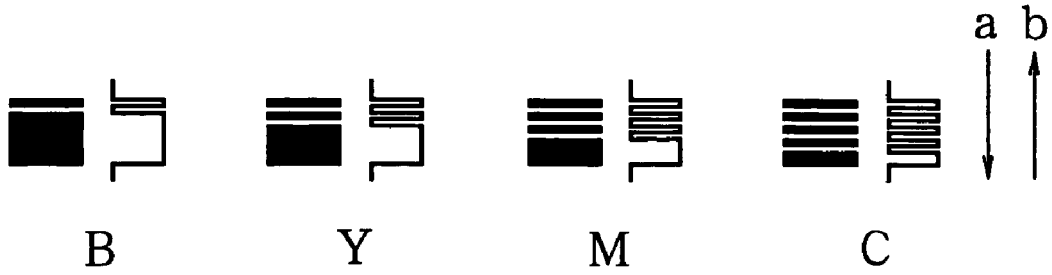
FIG. 20 illustrates an example of bar code.
Figure 21:
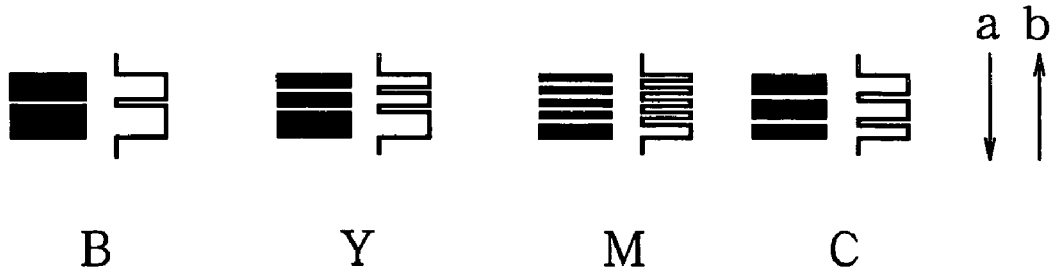
FIG. 21 illustrates another example of bar code.

FIG. 20 illustrates an example of bar code and FIG. 21 illustrates another example of bar code.

The bar code in FIG. 20 includes an arrow low-reflectivity bar(s) and a thick low-reflectivity bar(s). All bar codes in FIG. 20 have narrow low-reflectivity bars of the same width. The image-forming sections are assigned bar codes with different number of narrow low-reflectivity bars. The bar codes for B (black), Y (yellow), M (magenta), and C (cyan) have one, two, three, and four narrow low-reflectivity bars, respectively. The width of the thick low-reflectivity bar varies from image-forming section to image-forming section. However, the thick low-reflectivity bars are larger in width than the thin narrow low-reflectivity bars for all of the bar codes. The timer 30 measures the duration of the narrow pulse waveforms and thick pulse waveforms. An arrow b shows a direction in which the image-forming section moves downward, i.e., a direction in which the bar code is scanned. An arrow 2 shows a direction in which the image-forming section moves upward. The bar codes in FIG. 21 include narrow low-reflectivity bars and thick low-reflectivity bars. However, the narrow and thick low-reflectivity bars vary in width and number from bar code to bar code. In other words, the width and number are selected irregularly.

In the first embodiment, the toner sensor 25 is used in controlling the upward and downward movements of the image-forming section. The reflection plate 23 serves as a high-reflectivity material. The outer wall 2*a* of the image-forming section serves as a low-reflectivity material as shown in FIG. 16. Therefore, there is no need for providing an exclusive sensor for detecting the upward and downward movements of the image-forming section, so that the manufacturing cost of the apparatus can be reduced. The use of bar codes improves the accuracy in detecting the up- and down-positions of the image-forming sections.

Second Embodiment

Figure 22:
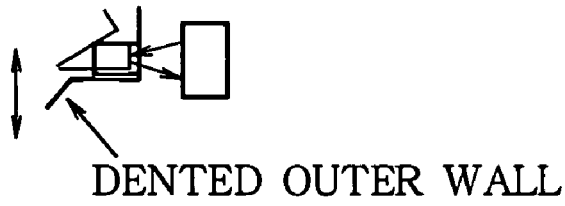
FIG. 22 is a perspective view illustrating a second embodiment in which the outer wall of the image forming section is dented or recessed.

FIG. 22 is a perspective view illustrating a second embodiment in which the outer wall 2*a* of the image forming section is dented or recessed. The second embodiment will be described with respect to only a portion different from the first embodiment. In the second embodiment, the toner sensor 25 is used in controlling the upward and downward movements of the image-forming section. The reflection plate 23 is used as a high reflectivity material, while the dented outer wall 2*a* of the image-forming section as shown in FIG. 22 serves as a low-reflectivity material. The distance between the toner sensor 25 and the outer wall 2*a* is longer than the focal length of the toner sensor 25, thereby preventing the most of the light reflected back from the outer wall 2*a* from entering.

The second embodiment eliminates the need for providing a bar code or a mark sheet on the outer wall 2*a* of the image-forming section. This reduces the number of parts and the time required for attaching a mark sheet on the outer wall 2*a*. The control of the upward and downward movements of the image-forming section is carried out in the same way as shown in the flowcharts in FIGS. 19A and 19B.

Third Embodiment

Figure 23:
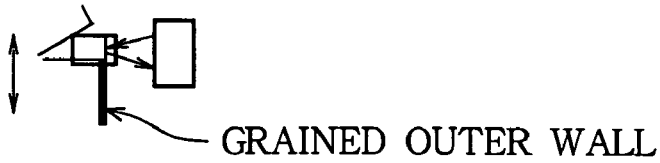
FIG. 23 illustrates the outer wall of the image-forming section formed by graining.

FIG. 23 illustrates the outer wall 2*a* of the image-forming section formed by graining.

Figure 24A:
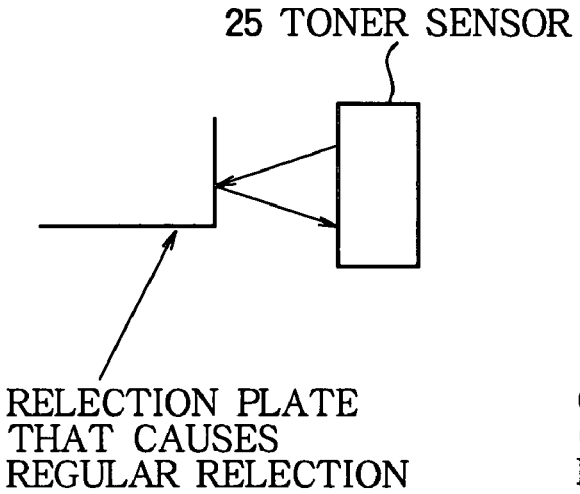
FIG. 24A illustrates regular reflection of the light at the reflection plate.

FIG. 24A illustrates regular reflection of the light at the reflection plate 23.

Figure 24B:
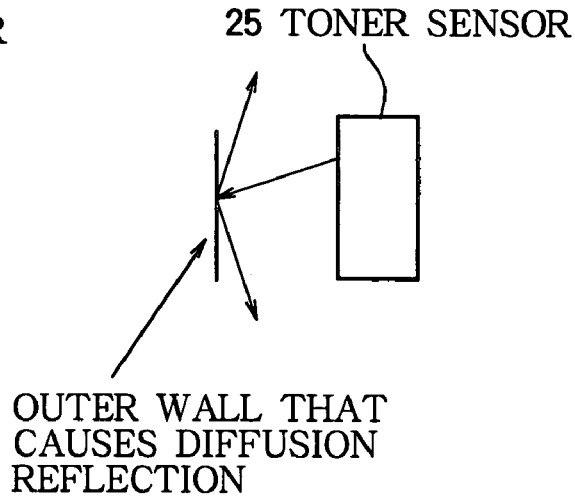
FIG. 24B illustrates diffusion reflection of the light at the outer wall.

FIG. 24B illustrates diffusion reflection of the light at the outer wall 2*a*.

Figure 24C:
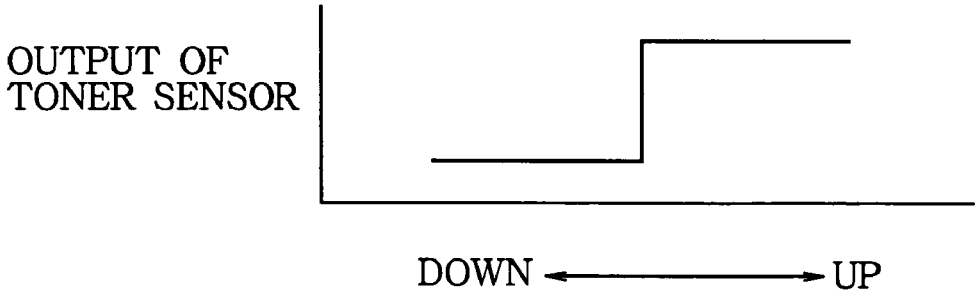
FIG. 24C illustrates the output of the toner sensor for the cases in FIGS. 24A and 24B.

FIG. 24C illustrates the output of the toner sensor 25 for the cases in FIGS. 24A and 24B.

In the third embodiment, the toner sensor 25 serves as a detector in controlling the upward and downward movements of the image-forming section. As shown in FIG. 23, the outer wall 2*a* of the image-forming section is grained, so that the outer wall 2*a* acts as a low-reflectivity member. Diffusion reflection of the light emitted from the toner sensor 25 takes place on the outer wall 2*a* formed by graining and therefore the amount of light incident on the toner sensor 25 is not sufficient to produce an output of a high logic level.

As shown in FIG. 23, the grained outer wall 2*a* of the image-forming section is below the window 24. When the image-forming section is at the down-position, the reflection plate 23 reflects the light emitted from the toner sensor 25. Due to regular reflection, the light directly enters the toner sensor 25 as shown in FIG. 24A. As a result, the output of the toner sensor 25 goes to a low logic level as shown in FIG. 24C. When the image forming section is at the up-position, the grained outer wall 2*a* reflects the light emitted from the toner sensor 25 by through diffusion reflection. Thus, the reflected light does not enter the toner sensor 25 and the output of the toner sensor 25 goes to a high logic level as shown in FIG. 24C.

Fourth Embodiment

The configuration of image-forming apparatus according to a fourth embodiment is the same as that of the third embodiment, and therefore only the operation of the apparatus will be described. In the fourth embodiment, a drive motor is driven by a predetermined amount of rotation, thereby moving the image-forming section from the up-position to the down-position or from the down-position to the up-position.

Figure 25A:
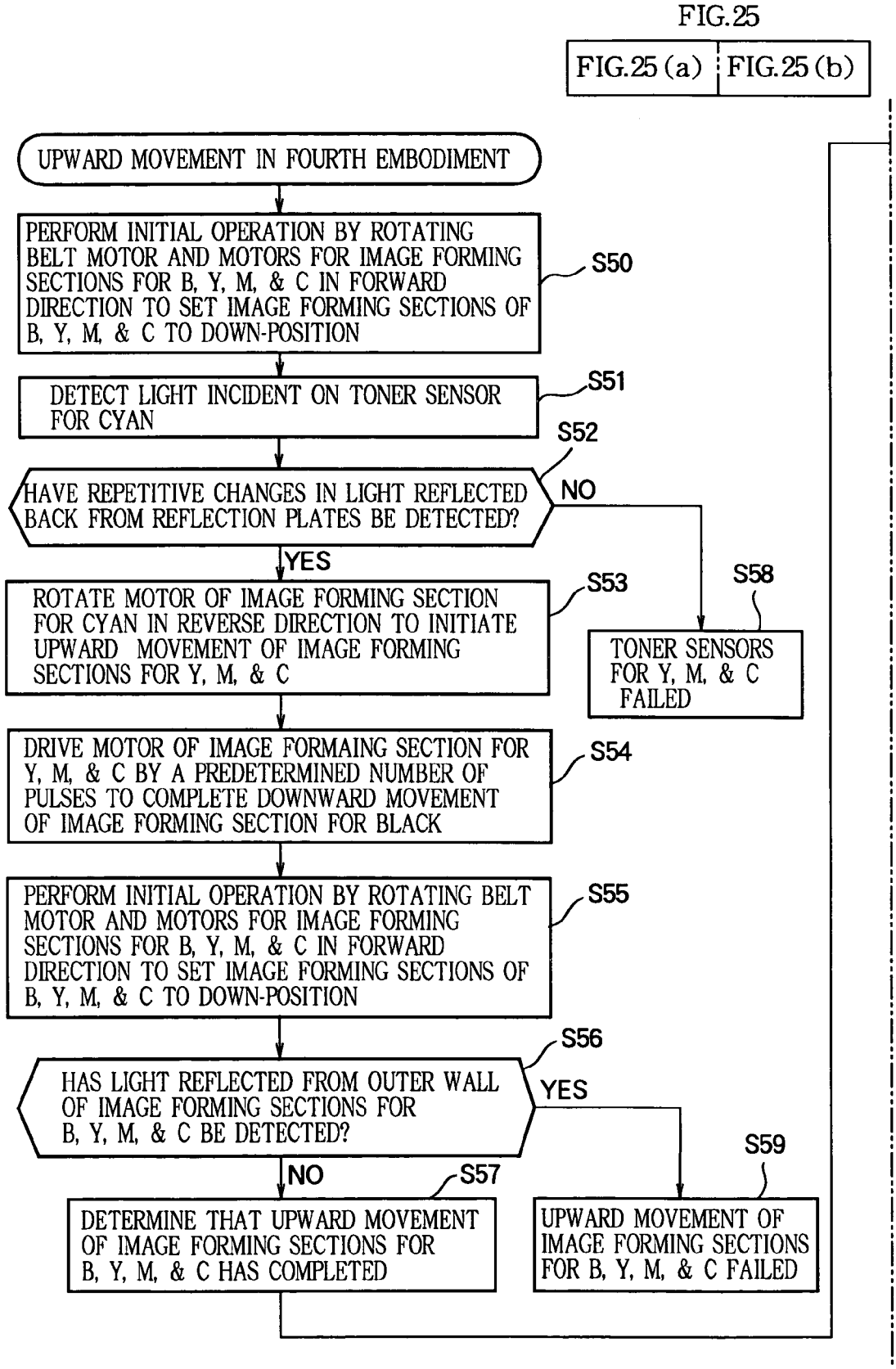
FIG. 25 illustrates the control of the upward movement of the image-forming section.
Figure 25B:
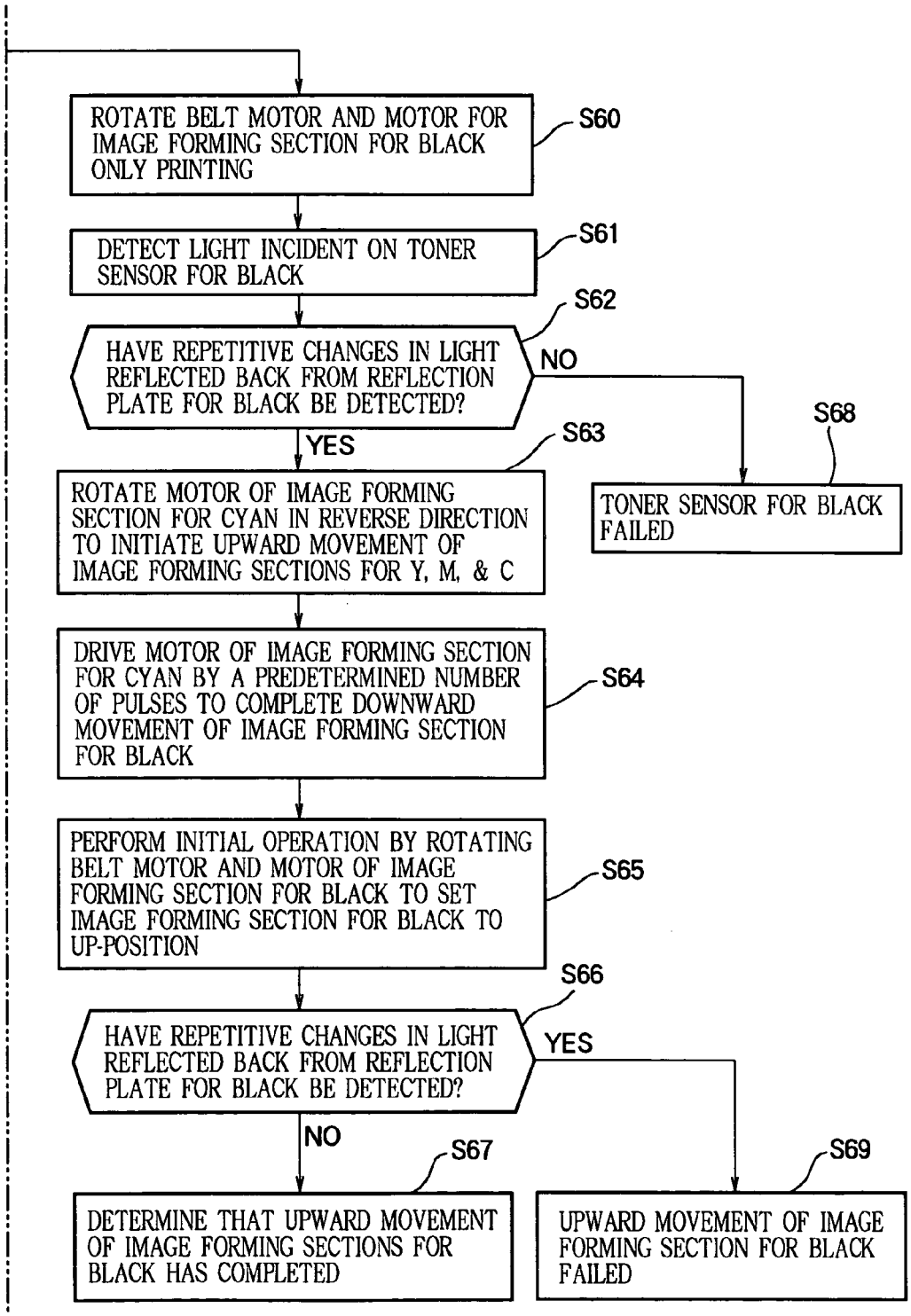
Figure 26:
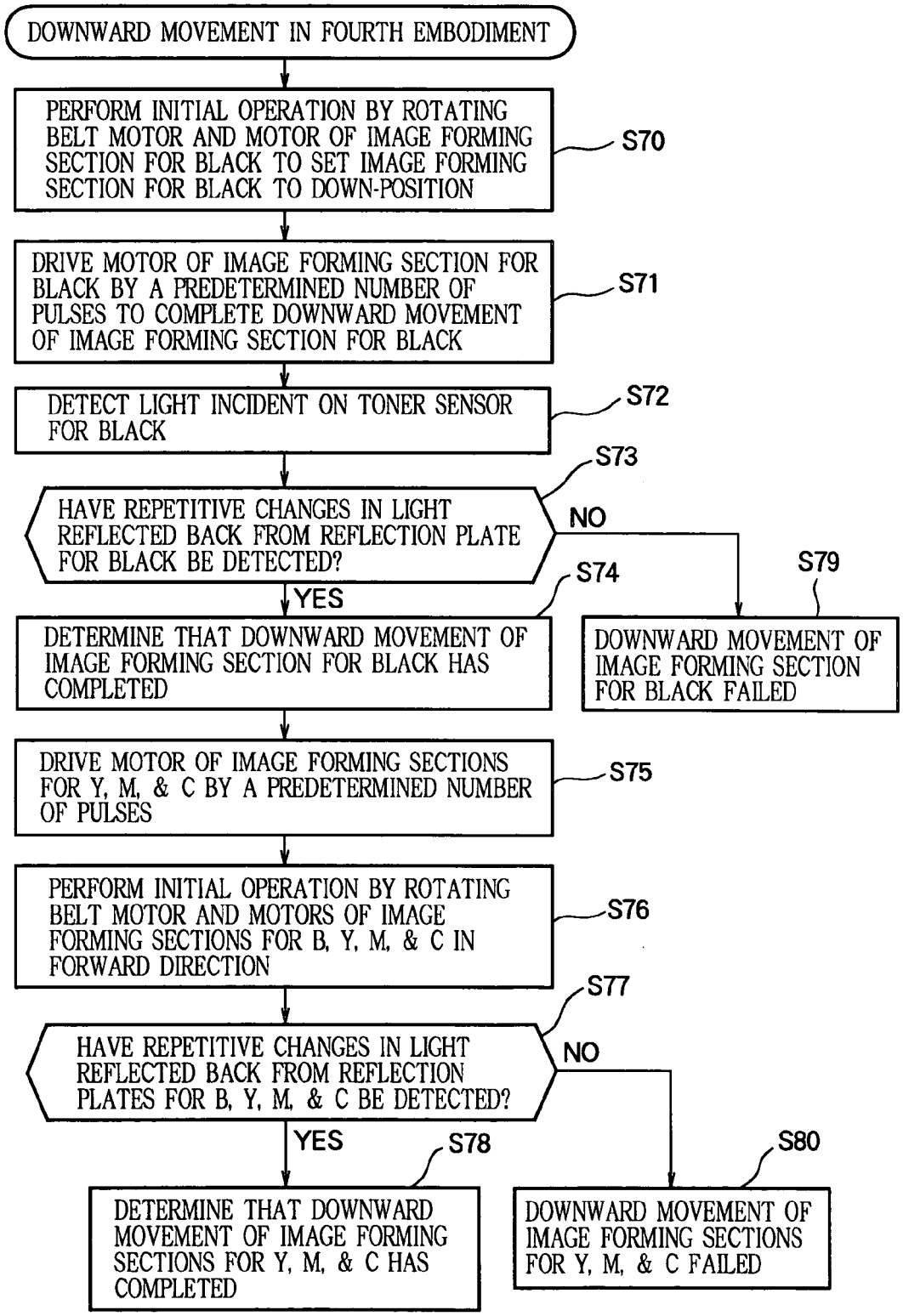
FIG. 26 illustrates the control of the downward movement of the image-forming section.

FIG. 25 illustrates the control of the upward movement of the image-forming section and FIG. 26 illustrates the control of the downward movement of the image-forming section.

The upward movement of the image-forming section will be described with reference to FIG. 25. Referring to FIG. 25, at step S50, an initial operation is performed. In other words, the belt motor and the drive motors of the image forming sections for black only printing and color printing are rotated in the forward direction, thereby placing all the image-forming sections at the down-position.

At step S51, the intensity of the light entering the toner sensor 25 for cyan is detected. At step S52, a check is made to determine whether the toner sensors 25 of the respective image-forming sections have detected repetitive changes in the output of the toner sensors 25 due to the rocking motion of the corresponding reflection plates 23. If the answer is NO, the program proceeds to step S58. If the answer is YES, the program proceeds to step S53. The sensor lever 21 stops at a position where the toner sensor 25 receives a sufficient amount of the light reflected back from the reflection plate 23. At step S53, the drive motor of the image-forming for cyan is rotated in the reverse direction, thereby initiating the upward movement of the image-forming sections (Y, M, and C). As step S54, the image-forming sections (Y, M, and C) for color printing are moved upward by a predetermined distance. At step S55, the belt motor and the drive motors of the image-forming sections for black only printing and color printing are rotated in the forward direction, thereby driving all the image-forming sections. At step S56, a check is made to determine whether the outputs of the toner sensors 25 for the respective image-forming sections have changed. If the answer is NO, the program proceeds to step S57. If the answer is YES, the program proceeds to S59.

At step S60, the belt motor and the drive motor of the image-forming section for black only printing are rotated. At step S61, the intensity of the light entering the toner sensor 25 for black is detected. At step S62, a check is made to determine whether the toner sensor 25 for black has detected a change in the light reflected back from the reflection plate 23. If the answer is NO, the program proceeds to step S68. If the answer is YES, the program proceeds to step S63. At this moment, the sensor lever 21 stops at a position where the toner sensor 25 receives a sufficient amount of light reflected back from the reflection plate 23. At step S63, the drive motor of the image-forming section for cyan is rotated in the reverse direction, thereby initiating the upward movement of the image-forming sections (Y, M, and C). At step S64, the image-forming section for black is moved upward by a predetermined distance. At step S65, an initial operation is performed. That is, the belt motor and the drive motor of the image-forming section for black only printing is rotated in the forward direction. At step S66, a check is made to determine whether the output of the toner sensor 25 for black has changed. If the answer is NO, the program proceeds to step S67, thereby completing the upward movement of the image-forming section for black only printing. If the answer is YES, the program proceeds to step S69.

The down movement of the image-forming section will be described with reference to FIG. 26. At step S70, an initial operation is performed. That is, the belt motor and the drive motor of the image forming section for black only printing are rotated in the forward direction. At step S71, the image-forming section for black only printing is moved downward by a predetermined distance. At step S72, the intensity of the light entering the toner sensor 25 for black is detected. At step S73, a check is made to determine whether the toner sensor 25 has detected the light reflected back from the reflection plate 23. If the answer is YES, the program proceeds to step S79. If the answer is NO, the program proceeds to step S74. At step S75, the image-forming sections for color printing are moved downward by a predetermined distance. At step S76, an initial operation is performed. That is, the belt motor and the drive motors of the image-forming sections for black printing and color printing are rotated in the forward direction. At step S77, a check is made to determine whether the toner sensors 25 for the respective image-forming sections have detected the light reflected by the reflection plates 23. If the answer is YES, the program proceeds to step S78, thereby completing the downward movement of the image-forming sections for color printing. If the answer is NO, the program proceeds to step S80.

Fifth Embodiment

Figure 27:
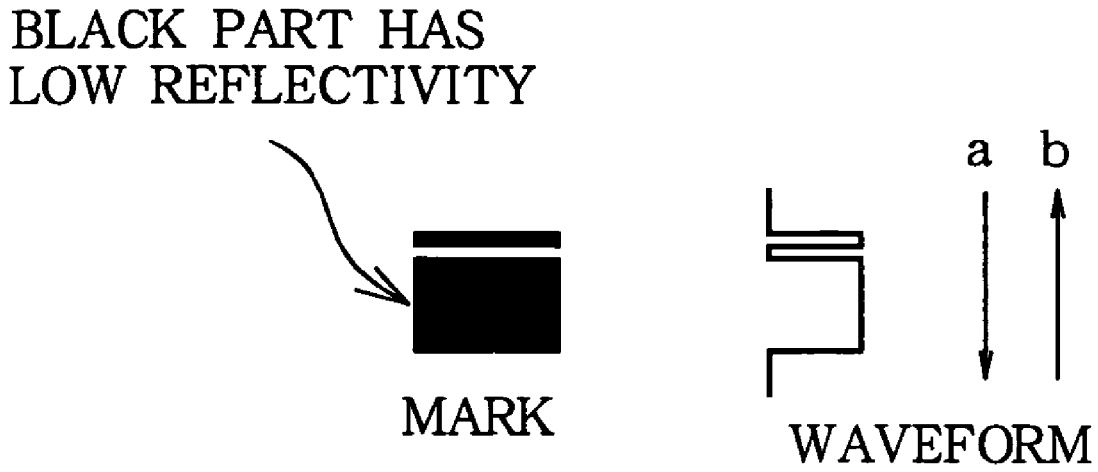
FIG. 27 illustrates a mark according to a fifth embodiment.

FIG. 27 illustrates a mark according to a fifth embodiment.

A toner sensor 25 located on the main body of the apparatus reads a mark as shown in FIG. 27. Then, the upward and downward movements of the image-forming section are detected based on the output of the toner sensor 25. An arrow a indicates that the image-forming section moves upward relative to the toner sensor 25. An arrow b indicates that the image-forming section moves downward relative to the toner sensor 25. The mark has a narrow slit inserted in its one end portion so that the output of the toner sensor 25 changes in a short length of time. Detection of the narrow slit provides an indication that the image-forming section has initiated its upward movement. The slit may be omitted if the beginning of the upward and downward movements of the image-forming sections can be detected properly. The black portion of the mark has a low-reflectivity. The slit and areas preceding and following the black portion have a high reflectivity.

The waveform of the output of the toner sensor 25 is a combination of a narrow pulse waveform and a wide (thick) pulse waveform. A timer 30 measures the duration of the narrow pulse waveform and the wide pulse waveform. Referring to FIG. 27, when the toner sensor 25 reads the thick low-reflectivity portion shortly after the narrow low-reflectivity portion, it is determined that the upward movement of the image-forming section has completed. When the toner sensor 25 reads the low-reflectivity portion shortly after the thick low-reflectivity portion, it is determined that the downward movement of the image-forming section has completed.

Figure 28A:
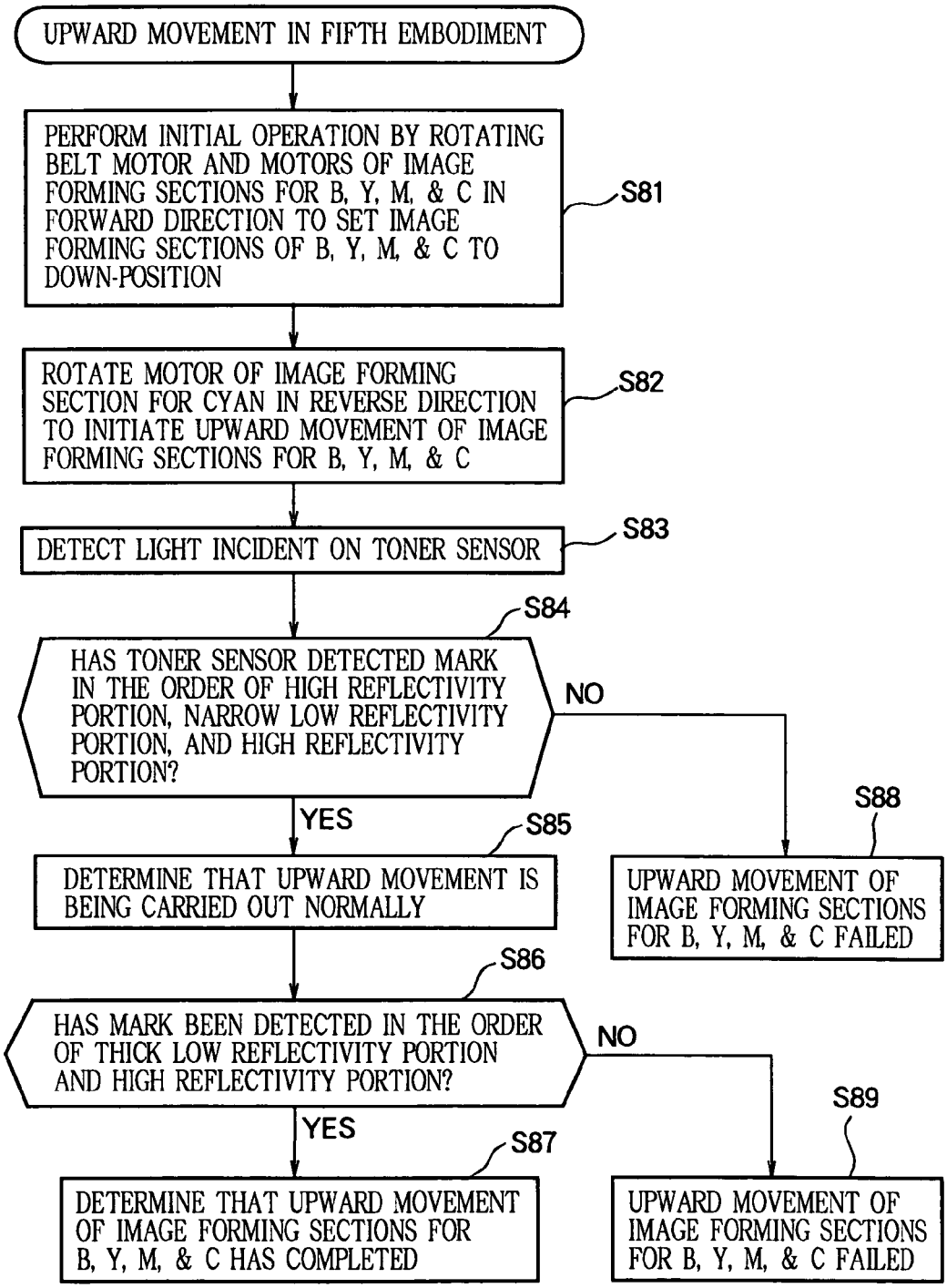
FIG. 28A is a flowchart illustrating the upward movement of the image forming section.

FIG. 28A is a flowchart illustrating the upward movement of the image forming section.

Figure 28B:
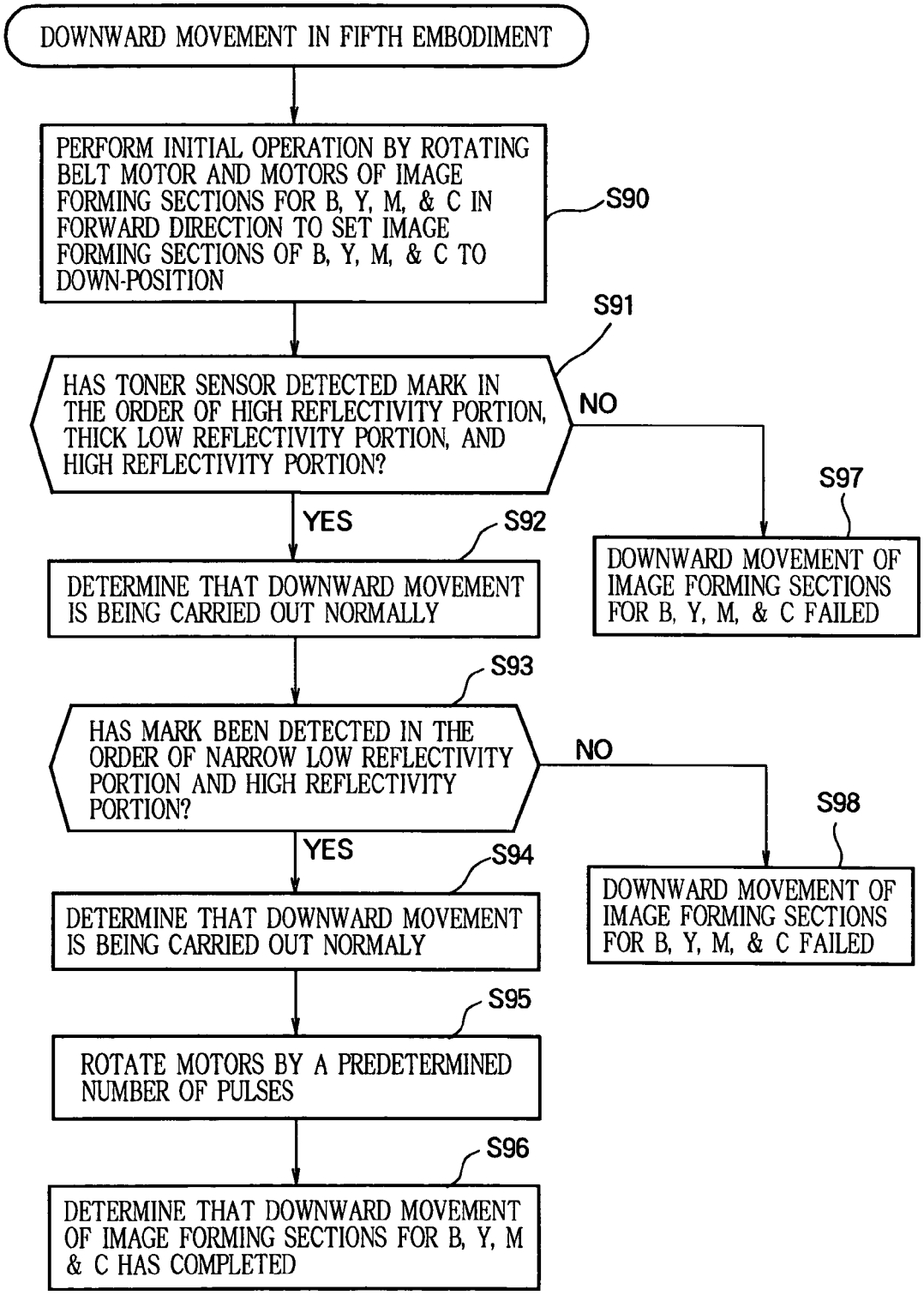
FIG. 28B is a flowchart illustrating the downward movement of the image forming section.

FIG. 28B is a flowchart illustrating the downward movement of the image forming section.

The upward movement of the image forming section will be described with reference to FIG. 28A.

{Upward Movement}

At step S81, an initial operation is performed. That is, the belt motor and drive motors of the image-forming sections for black only printing and color printing are rotated in the forward direction, thereby placing all the image-forming sections at the down-position.

In this manner, regardless of where the respective image-forming sections are positioned before their upward movement, the rotation of the motor substantially equivalent to one rotation of the photoconductive drum is sufficient to bring the image-forming section to the down-position. As step S82, the drive motor of the image-forming section for cyan is rotated in the reverse direction, thereby initiating the upward movement of the image-forming sections. As step S83, the level of the output of the toner sensor 25 for cyan is detected. At step S84, a checker is made to determine whether the toner sensor 25 has detected the mark in the order of a high reflectivity portion, a narrow low reflectivity portion, and a high reflectivity portion. If the answer is NO, the program proceeds to step S88. If the answer is YES, the program proceeds to step S85. At step S85, it is determined that the upward movement is being carried out normally. At step S86, a check is made to determine whether the mark has been detected in the order of a thick low reflectivity portion and a high reflectivity portion. If the answer is NO, then the program proceeds to step S89. If the answer is YES, then the program proceeds to step S87.

{Downward Movement}

The downward movement of the image-forming section will be described with reference to FIG. 28B.

At step S90, an initial operation is performed. That is, the belt motor and the drive motor of the image-forming sections for black only printing and color printing are rotated in the forward direction, thereby initiating the downward movement of all the image forming sections. At step S91, a check is made to determine whether the toner sensor 25 has detected the mark in the order of a high reflectivity portion, a thick low reflectivity portion, and a high reflectivity portion. If the answer is NO, the program proceeds to step S97. If the answer is YES, the program proceeds to step S92. At step S93, a check is made to determine whether the toner sensor 25 has detected the mark in the order of the narrow low reflectivity and the high reflectivity portion. If the answer is NO, the program proceeds to step S98. If the answer is YES, the program proceeds to step S94. At step S94, it is determined that the downward movement of the image-forming section is being carried out normally. At step S95, the respective motors are rotated by a predetermined number of pulses, allowing the respective image-forming sections to move sufficiently downward. At step S96, the downward movement of the image forming sections has completed. Just as in the fourth embodiment, the sensor leave 21 is positioned so that the reflection plate 23 directly faces the toner sensor 25 before the upward movement of the image forming section.

Sixth Embodiment

A sixth embodiment differs from the fifth embodiment in that a bar code is used in place of a simple mark for detecting the upward and downward movements of the image-forming section.

Figure 29:
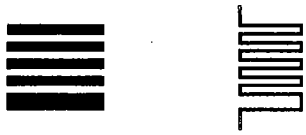
FIG. 29 illustrates the bar code according to a sixth embodiment.

FIG. 29 illustrates the bar code according to the sixth embodiment.

The bar code according to the sixth embodiment is more complicated than the mark according to the fifth embodiment, allowing more accurate detection of the position of the image-forming section. The bar code is a combination of a plurality of low-reflectivity bars and a plurality of high-reflectivity bars. In the sixth embodiment, all the image-forming sections use the same bar code.

Referring back to FIG. 27, the arrow a indicates a direction in which the image-forming section moves upward relative to the toner sensor 25 and the arrow 2 shows a direction in which the image-forming section moves downward relative to the toner sensor 25. When the image-forming section moves upward or downward, the bar code traverses the path of the light emitted from the toner sensor 25 so that the toner sensor 25 reads the bar code. A counter 31 receives pulses, outputted from the toner sensor 25, through the controller 32 (FIG. 9), and counts the number of pulses starting from the beginning of a change in the output of the toner sensor 25. This enables the detection of upward and downward movements of the image-forming section.

Referring to FIG. 29, the bar code includes four narrow low-reflectivity bars (dark portion) and a thick low-reflectivity bar (dark portion). When the toner sensor 25 has read the four narrow low-reflectivity bars and the thick low-reflectivity bar, it is determined that the upward movement of the image-forming section has completed. The four narrow low-reflectivity bars are designed such that the toner sensor 25 outputs a pulse train having a predetermined number of logic levels of "1" and "0". The four narrow low-reflectivity bars may have slightly different widths but should have sufficiently narrower widths than the thick low-reflectivity bar. The waveform of the output of the toner sensor 25 is in the shape of a pulse train that is counted by the counter 31.

When the image-forming section is at the up-position, an error in the height of the image-forming section is not critical providing that the image-forming section is higher than a predetermined height. However, when the image-forming section is to be moved to the down-position, the image-forming section requires to be accurately positioned at the down-position. In the fifth embodiment, the image forming sections may fail to achieve proper upward and downward movements due to slightly insufficient amount of movement. The use of the bar code according to the sixth embodiment allows more accurate detection of the up-position and down-position of the image forming section, being effective in preventing positional errors of the image forming section.

Figure 30A:
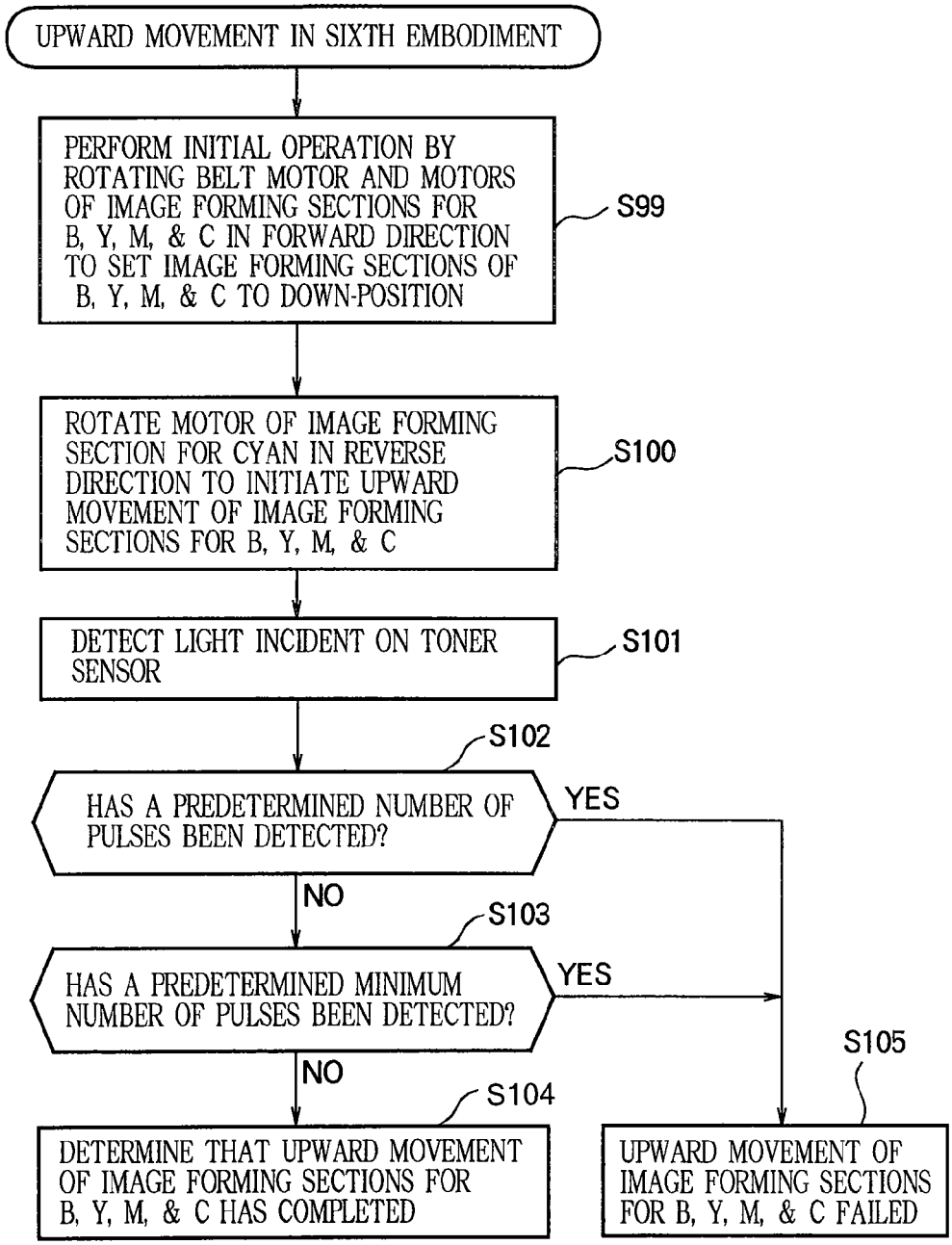
FIG. 30A is a flowchart illustrating the upward movement of the image forming sections according to the sixth embodiment.

FIG. 30A is a flowchart illustrating the upward movement of the image-forming sections according to the sixth embodiment.

The upward movement of the image-forming section will be described with reference to FIG. 30A.

At step S99, an initial operation is carried out. That is, the belt motor and the drive motors of the image-forming sections for black only printing and color printing are rotated in the forward direction, thereby placing all the image-forming sections at the down-position. At step S100, the drive motor of the image-forming section for cyan is rotated in the reverse direction, thereby initiating the upward movement of the image-forming section. At step S101, the intensity of the light entering the toner sensor 25 for cyan is detected. At step S102, a check is made to determine whether the toner sensor 25 for cyan has detected a predetermined first number of pulses enough for moving the image-forming section upward to a sufficient height. If the answer is YES, the program proceeds to step S105. If the answer is NO, the program proceeds to step S103 where a check is made to determine whether the toner sensor 25 has detected a predetermined second number of pulses enough for moving the image-forming section to a just high enough position. The first number of pulses is larger than the second number of pulses. If the answer is YES, the program proceeds to step S105 where the upward movement completes. If the answer is NO, the program proceeds to step S104.

Figure 30B:
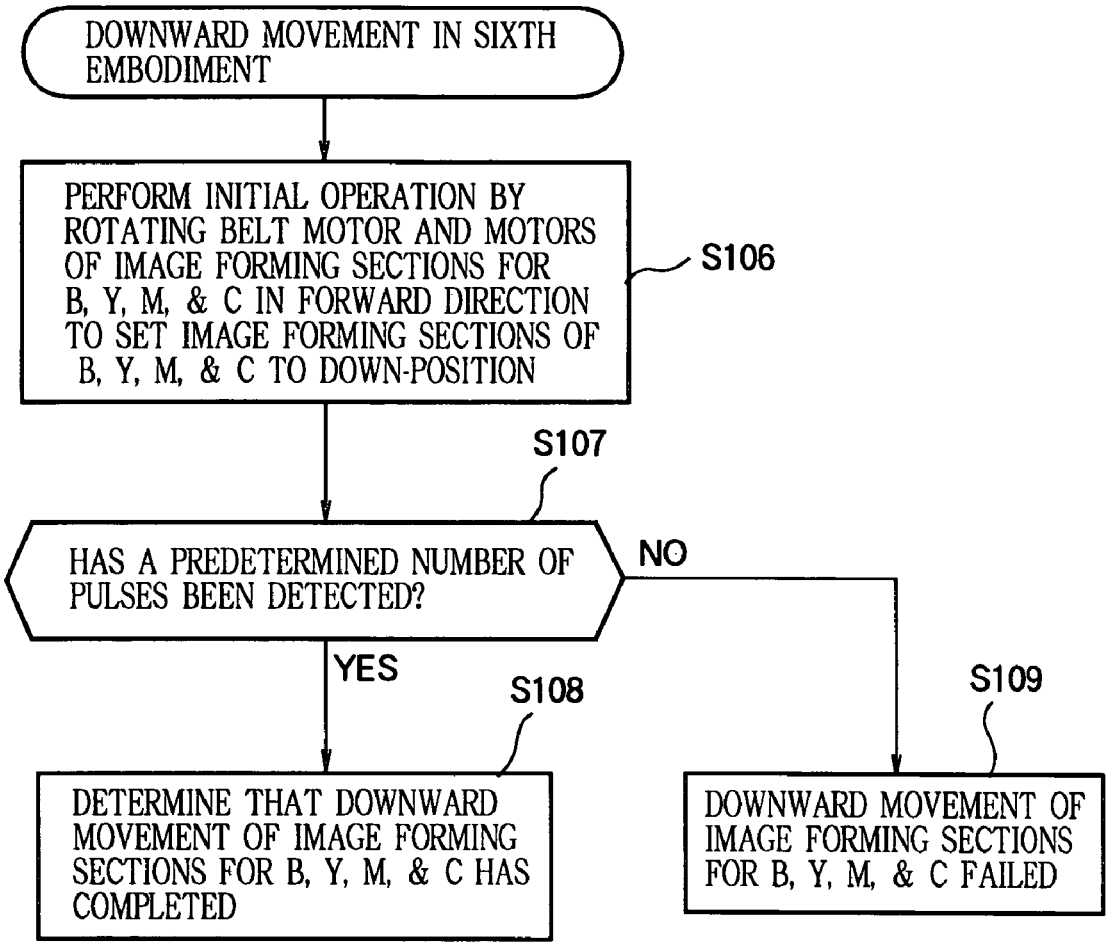
FIG. 30B is a flowchart illustrating the downward movement of the image forming sections according to the sixth embodiment.

FIG. 30B is a flowchart illustrating the downward movement of the image-forming sections according to the sixth embodiment. The downward movement of the image forming section will be described with reference to FIG. 30B.

At step S106, an initial operation is carried out. That is, the belt motor and the drive motors of the image-forming sections for black only printing and color printing are rotated in the forward direction, thereby placing all the image-forming sections at the down-position. At step S107, a check is made to determine whether the toner sensor 25 has detected the predetermined first number of pulses. If YES, the program proceeds to step S108 where the downward movement of the image-forming section completes. If the answer is NO, the program proceeds to step S109. When the image-forming section moves to the down position, the image-forming section needs to move by the predetermined first number of pulses. If the toner sensor 25 detects a smaller number of pulses than the first number of pulses, it means that the image forming section has not moved downward normally. This may cause trouble of the operation of the image-forming section. Just as in the fifth embodiment, the sensor leave 21 is positioned so that the reflection plate 23 directly faces the toner sensor 25 before the upward movement of the image forming section.

The modification to the sixth embodiment will be described with reference to FIGS. 31A–31D.

Figure 31A:
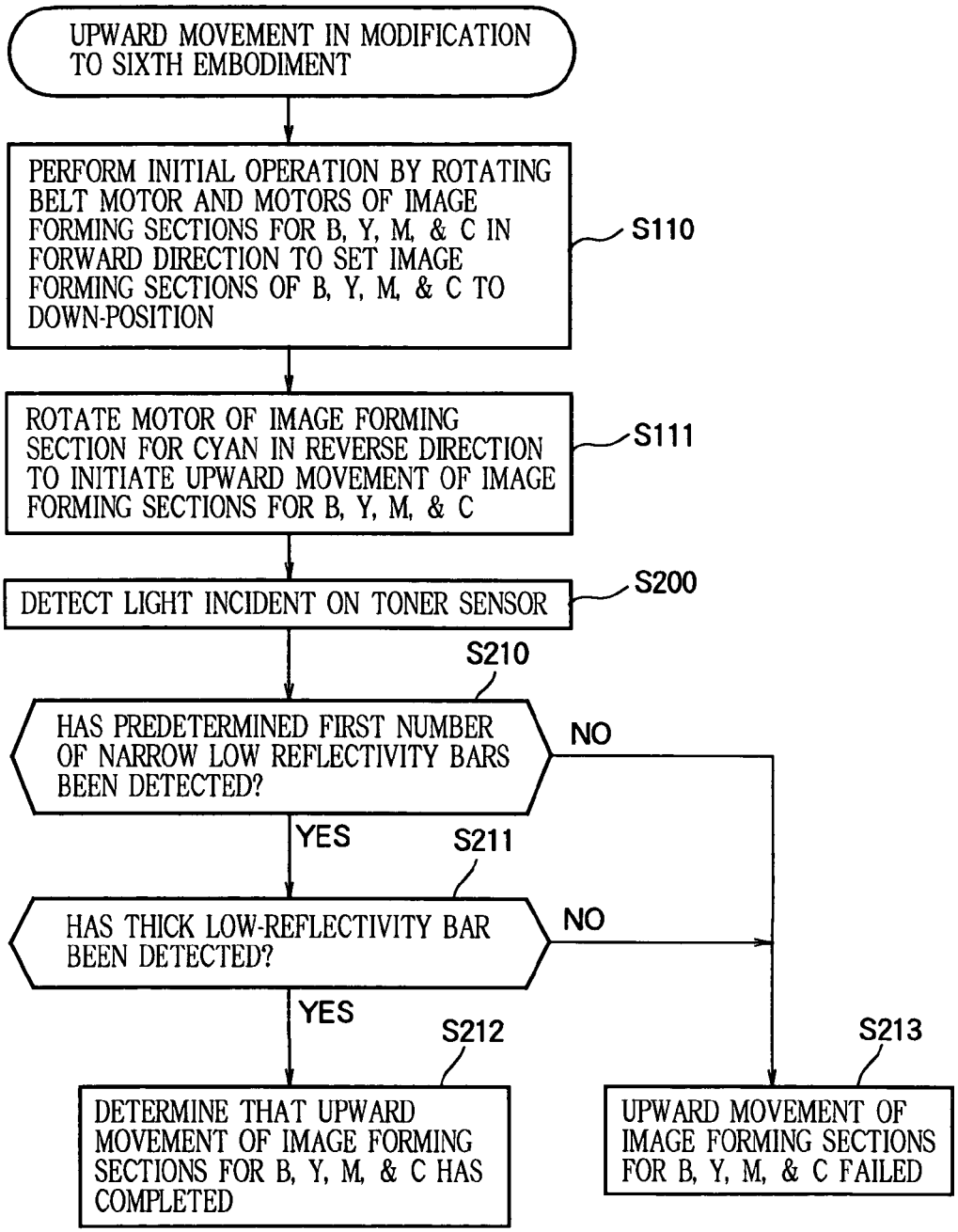
FIG. 31A is a flowchart illustrating the control of the upward movement of the image forming section.

FIG. 31A is a flowchart illustrating the control of the upward movement of the image forming section.

At step S110, an initial operation is carried out. That is, the belt motor and the drive motors of the image forming sections for black only printing and color printing are rotated in the forward direction, thereby placing all the image forming sections at the down-position. At step S111, the drive motor of the image forming section for cyan is rotated in the reverse direction, thereby initiating the upward movement of the image-forming section. As step S200, the level of the output of the toner sensor 25 for cyan is detected. At step S210, the timer 30 (FIG. 9) measures the widths of the narrow pulses and thick pulse and the counter 31 (FIG. 9) counts the number of pulses, thereby determining whether the toner sensor 25 has detected the predetermined first number of narrow low-reflectivity bars (dark narrow-width bars). If the answer is NO, the program proceeds to step S213. If the answer is YES, the program proceeds to step S211 where a check is made to determine whether the toner sensor 25 has detected the thick low-reflectivity bar. If the answer is YES, the program proceeds to step S212 where the upward movement of the image-forming section completes. If the answer is NO, the program proceeds to step S213.

Figure 31B:
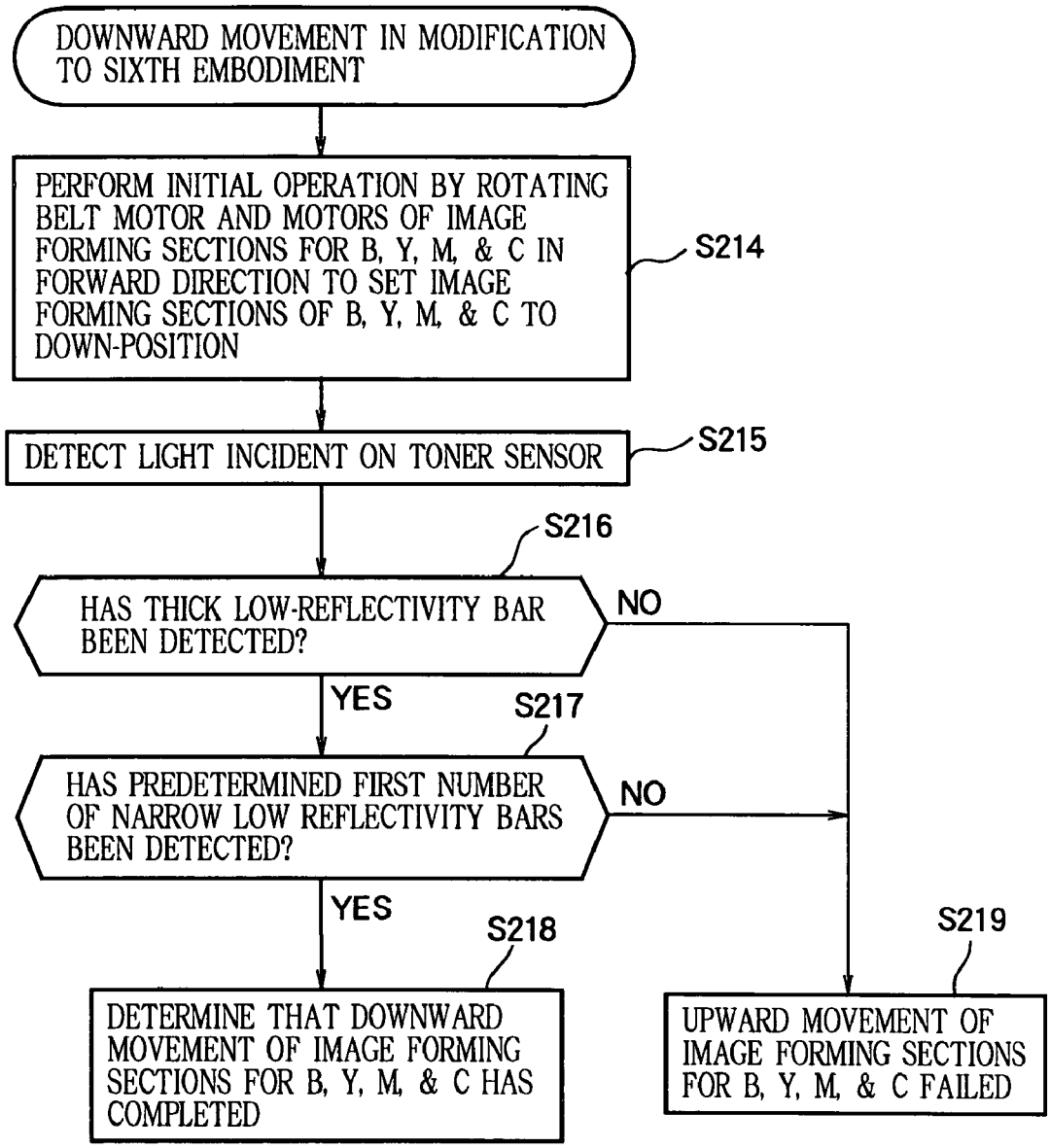
FIG. 31B is a flowchart illustrating the downward movement of the image-forming section.

FIG. 31B is a flowchart illustrating the downward movement of the image-forming section.

At step S214, an initial operation is carried out. That is, the belt motor and the drive motors of the image-forming sections for black only printing and color printing are rotated in the forward direction, thereby placing all the image forming sections at the down-position. At step S215, the intensity of the light entering the toner sensor 25 is detected. At step S216, the timer 30 measures the duration of the narrow pulse waveform and thick pulse waveform and a check is made to determine whether the toner sensor 25 has detected the thick low-reflectivity portion (wide width portion). If the answer is NO, the program proceeds to step 219. If the answer is YES, the program proceeds to step 217. At step S217, the number of narrow pulses is counted, thereby making a decision to determine whether a predetermined number of narrow low-reflectivity portions have been counted. If the answer is YES, the program proceeds to S218. If the answer is NO, the program proceeds to S219.

Figure 31C:
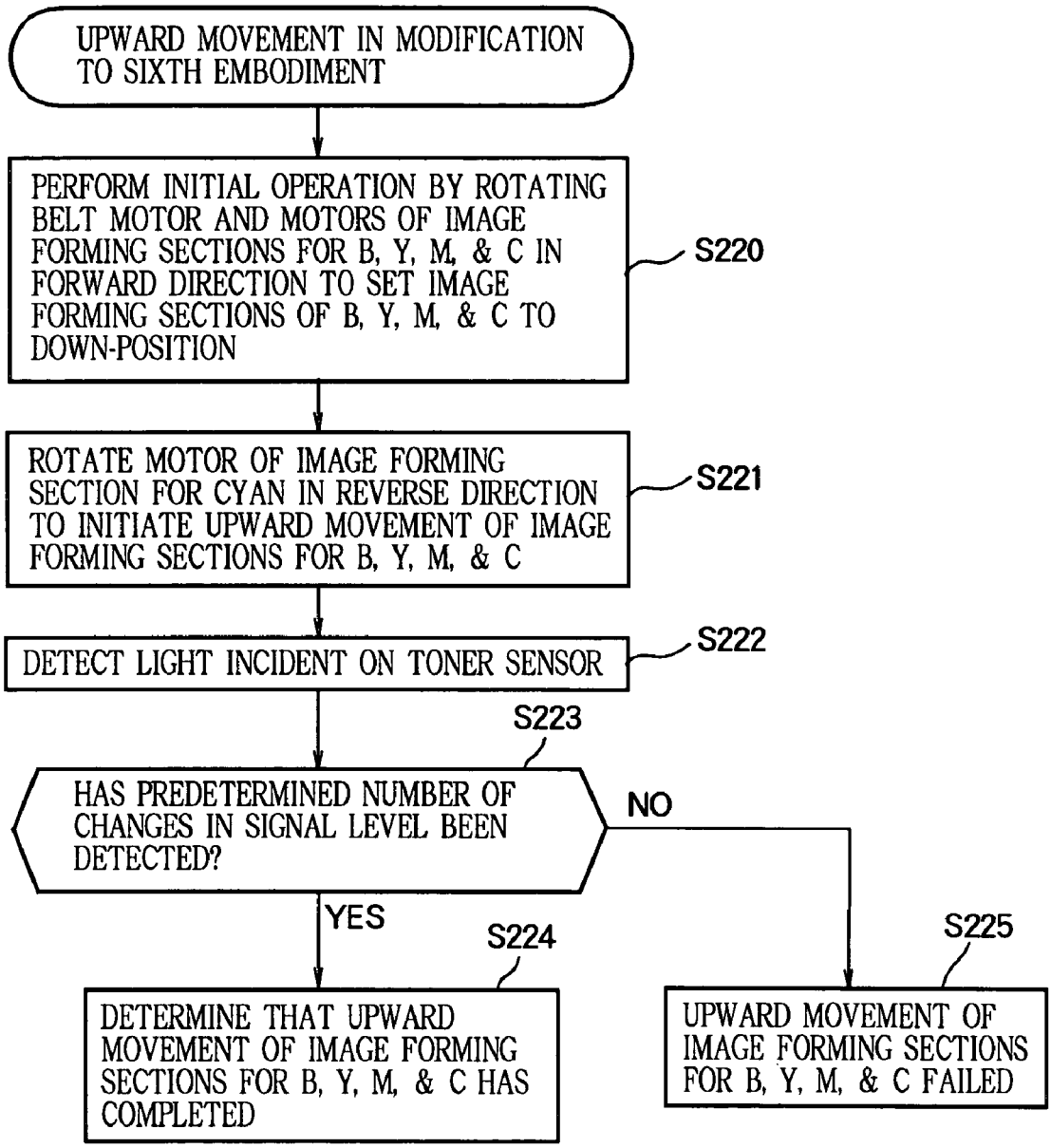
FIG. 31C is a flowchart illustrating the upward movement of the image-forming section.

FIG. 31C is a flowchart illustrating the upward movement of the image-forming section.

At step S220, an initial operation is carried out. That is, the belt motor and the drive motors of the image-forming sections for black only printing and color printing are rotated in the forward direction, thereby placing all the image-forming sections at the down-position. At step S221, the drive motor of the image-forming section for cyan is rotated in the reverse direction, thereby initiating the upward movement of the image-forming section. At step S222, the output of the toner sensor 25 for cyan is detected. At step S223, a check is made to determine whether the toner sensor 25 has detected a predetermined number of changes in signal level (pulse train in FIG. 29). If the answer is YES, the program proceeds to step S224 where the downward movement completes. If the answer is NO, the program proceeds to step S225.

Figure 31D:
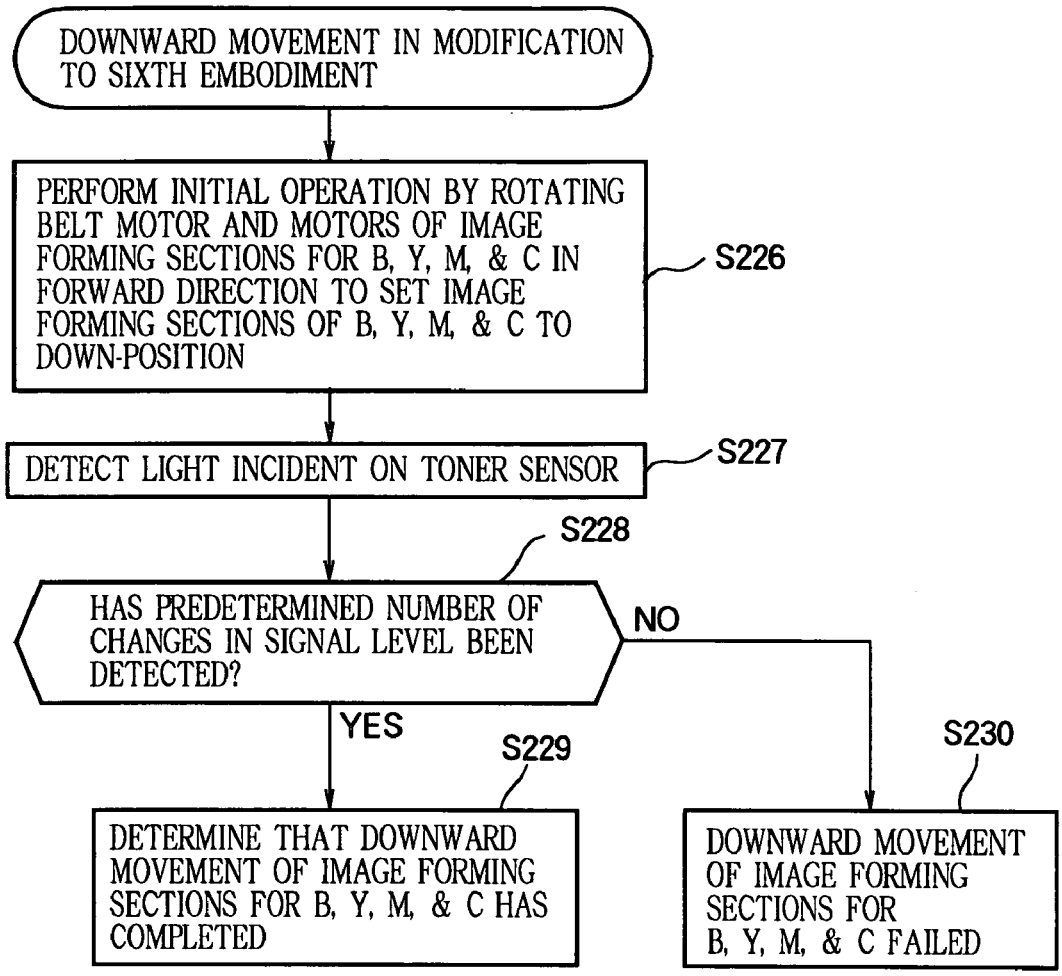
FIG. 31D is a flowchart illustrating another control of the downward movement of the image-forming section.

FIG. 31D is a flowchart illustrating another control of the downward movement of the image-forming section.

At step S226, an initial operation is carried out. That is, the belt motor and the drive motors of the image-forming sections for black only printing and color printing are rotated in the forward direction, thereby placing all the image-forming sections at the down-position. At step S227, the output of the toner sensor 25 for cyan is detected. At step S228, a check is made to determine whether the toner sensor 25 has detected a predetermined number of changes in signal level (pulse train in FIG. 30). If the answer is YES, the program proceeds to step S229 where the downward movement completes. If the answer is NO, the program proceeds to step S230.

Seventh Embodiment

Figure 32:
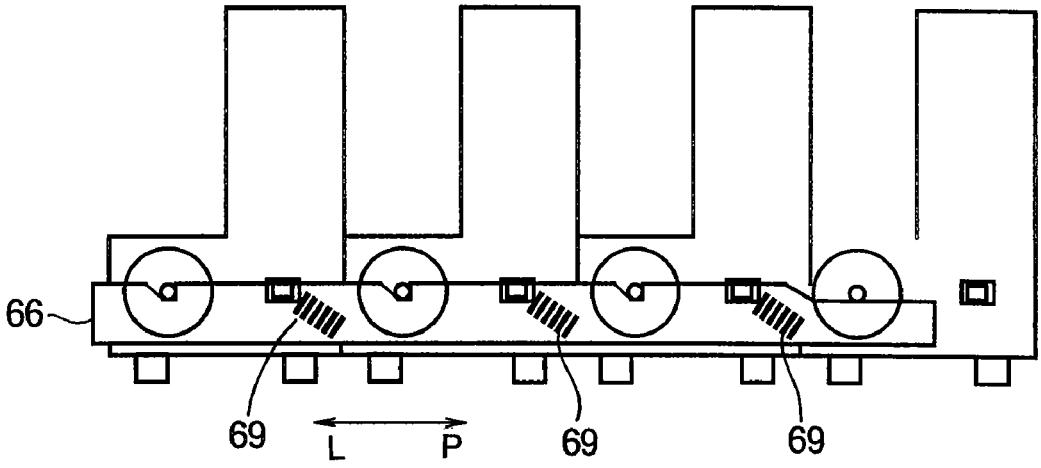
FIG. 32 is a side view of an image-forming apparatus according to a seventh embodiment.

FIG. 32 is a side view of an image-forming apparatus according to a seventh embodiment.

Figure 33:
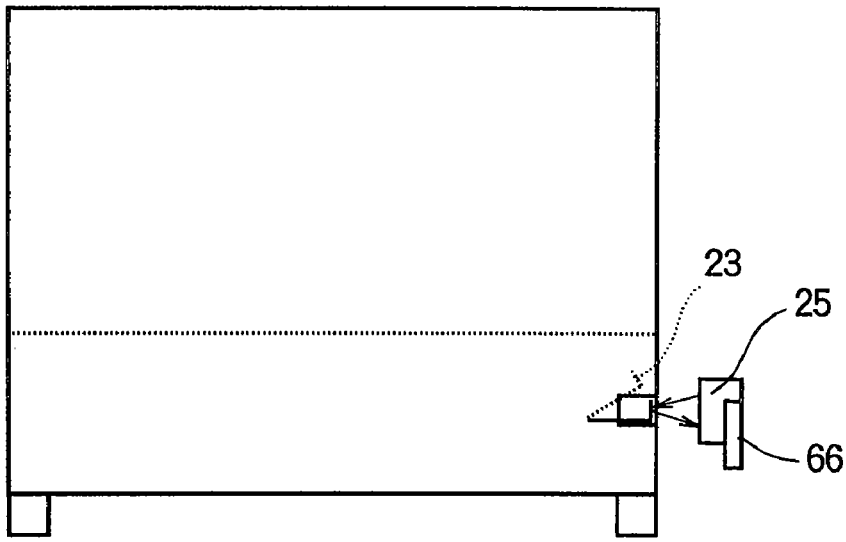
FIG. 33 illustrates the positional relation between the toner sensor and the image-forming section.

FIG. 33 illustrates the positional relation between the toner sensor 25 and the image-forming section.

It is to be noted that the bars of the respective bar codes 69 (FIG. 32) are formed on the outer wall 2*a* of the respective image-forming sections and aligned in directions oblique to the upward and downward directions. The bars of the respective bar codes are aligned in directions parallel to the inclined surfaces 70*c* and 71c (FIG. 14).

The toner sensors 25 are mounted on the side surface of the slide link 66 at locations where when the slide link 66 moves in the P and L directions, the toner sensor 25 scans across the bar code 69 to read the bar code 69. The stroke of the slide link 66 in the P and L directions is larger than the distance over which the image-forming section moves upward and downward, and therefore provides high accuracy in detecting the upward and downward movement of the image-forming section. Practically, the image-forming sections move only about 5 mm in upward and downward directions. The image-forming section for color printing are at the up-position during black only printing in order to stop the rotation of the image-forming sections and prevent the photoconductive drums from being contaminated. Thus, a change of only 5 mm in height is sufficient, providing that the image-forming sections are spaced apart from the belt 20 and isolated from high voltage control signals. In order to minimize the amount of stroke of the slide link 66 and a load exerted on the drive source of the slide link 66, the amount of stroke of the slide link 60 is selected to be about 10 mm.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image-forming apparatus comprising:

an image-forming section having an image-bearing body on which an electrostatic latent image is formed and a developing unit that applies toner to the electrostatic latent image;

a detection section that generates an output indicative of a remaining amount of toner in the developing unit;

a drive section that causes said image-forming section to move from one position to another; and a controller that drives said drive section to cause said image-forming section to move from one position to another and determines a position of said image-forming section based on the output of said detection section.

2. The image-forming apparatus according to claim 1, wherein said detection section is mounted to a toner cartridge within the developing unit.

3. The image-forming apparatus according to claim 1, wherein said image-forming section has an outer wall on which a high-reflectivity section and a low-reflectivity section are provided;

wherein when said image-forming section is moved from one position to another, the high-reflectivity section and the low-reflectivity section pass through a path of light emitted from said detection section in order, so that said detection section detects light reflected from the high-reflectivity section and the low-reflectivity section.

4. The image-forming apparatus according to claim 3, wherein the developing unit includes a toner agitating member that agitates the toner in the developing unit;

wherein the high-reflectivity section is a reflection member that cooperates with the toner agitating member to perform rocking motion to indicate the remaining amount of toner;

wherein the low-reflectivity section is the outer wall surface of said image-forming section.

5. The image-forming apparatus according to claim 4, wherein the low-reflectivity section is a dented area of the outer wall surface;

wherein said detection section has a focal distance longer than a distance between said detection section and the dented area when the dented area is in the path of light emitted from said detection section.

6. The image-forming apparatus according to claim 4, wherein the low-reflectivity section is an outer wall surface on which diffusion reflection of incident light takes place.

7. The image-forming apparatus according to claim 1, wherein said image forming section has an outer wall having a bar code thereon;

wherein when said image-forming section is moved from one position to another, the bar code passes said detection section, so that said detection section reads the bar code.

8. The image-forming apparatus according to claim 1, wherein said image-forming section is one of a plurality of image-forming sections that have different bar codes.

9. The image-forming apparatus according to claim 1, wherein the position of said image-forming section is detected in terms of a duty cycle of an output waveform of said detection section.

10. The image-forming apparatus according to claim 1, wherein the position of said image-forming section is detected in terms of a number of pulses of an output waveform of said detection section.

11. A toner cartridge comprising:

a toner chamber that holds toner therein;

a toner-agitating member that agitates the toner in said toner chamber; and a detection section located in a chamber partioned off from of said toner chamber by a solid wall and cooperating with said toner agitating member to detect a motion of said toner-agitating member.

12. A toner cartridge comprising:

a toner chamber that holds toner therein;

a toner-agitating member that agitates the toner in said toner chamber;

a detection section located outside of said toner chamber and cooperating with said toner agitating member to detect a motion of said toner-agitating member, wherein said toner agitating member includes a first portion that agitates the toner and a second portion that transmits a motion of said agitating member to said detection section;

wherein said detection section has one end with a driven portion and another end with a light reflecting portion, said detection section being supported at a fulcrum between the driven portion and the light reflecting portion so that said detection section is adapted to rock about the fulcrum.

13. The toner cartridge according to claim 12, wherein the driven portion is a magnet and the second portion is formed of a magnetic material;

wherein when the second portion moves toward the driven portion, the second portion attracts the driven portion, and when the second portion moves away from the driven portion, the second portion does not attract the driven portion so that the detection section rocks about the fulcrum.

14. The toner cartridge according to claim 13, wherein when said detection section rocks about the fulcrum, the light reflecting portion reflects light incident thereon, the light being reflected alternately in a first direction and in a second direction.

15. A toner cartridge comprising:

a toner chamber that holds toner therein;

a toner-agitating member that agitates the toner in said toner chamber;

a detection section located outside of said toner chamber and cooperating with said toner agitating member to detect a motion of said toner-agitating member;

a toner-discharging opening through which the toner is discharged from said toner chamber; and a shutter member that opens and closes said toner-discharging opening;

wherein said detection section is mounted to said shutter member.

16. The toner cartridge according to claim 15, further comprising an operation handle operated for opening and closing said shutter member;

wherein when the operation handle is operated, said detection section moves together with said shutter member.

17. The toner cartridge according to claim 16, wherein said detection section has a light-reflecting member and said operation handle has a window through which light emitted from an external light source is incident on the light-reflecting member.

18. The toner cartridge according to claim 17, wherein when said operation handle is operated, the light-reflecting member takes either a reflection position where the light-reflecting member reflects the light emitted from the external light source or a non-reflection position where the light-reflecting member does not reflect the light emitted from the external light source.

* * * * *